United States Patent [19]

Landry et al.

[11] 4,092,041

[45] May 30, 1978

[54] CHAIR UNIVERSALLY ADJUSTABLE BY OCCUPANT RECLINING THEREIN, AND METHOD

[75] Inventors: Archie C. Landry, Canoga Park; Alexander C. Daswick, South Pasadena, both of Calif.

[73] Assignee: Alexander C. Daswick, South Pasadena, Calif.

[21] Appl. No.: 760,997

[22] Filed: Jan. 21, 1977

[51] Int. Cl.[2] ..... A47C 1/02; A47C 3/02

[52] U.S. Cl. ..... 297/68; 297/DIG. 7; 297/271

[58] Field of Search ..... 297/316, 271, 258, DIG. 7, 297/85, 433, 278, 68

[56] References Cited

U.S. PATENT DOCUMENTS

| | | | |
|---|---|---|---|
| 524,279 | 8/1894 | Kottmann | 297/278 |
| 2,764,224 | 9/1956 | Maurer | 297/316 UX |
| 2,834,397 | 5/1958 | Kluglein et al. | 297/DIG. 7 |
| 3,173,720 | 3/1965 | Noda | 297/316 |
| 3,330,595 | 7/1967 | Svärd | 297/316 X |
| 3,376,067 | 4/1968 | Kernes | 297/433 X |
| 3,427,072 | 2/1969 | Hale | 297/316 X |
| 3,491,998 | 1/1970 | Lyon | 297/316 |
| 3,493,264 | 2/1970 | Ré | 297/DIG. 7 |
| 3,695,685 | 10/1972 | Lamb | 297/29 |
| 3,712,671 | 1/1973 | Dalton | 297/DIG. 7 |

FOREIGN PATENT DOCUMENTS

| | | | |
|---|---|---|---|
| 1,083,997 | 6/1960 | Germany | 297/278 |
| 1,427,592 | 3/1976 | United Kingdom | 297/258 |

*Primary Examiner*—James T. McCall

[57] ABSTRACT

A reclining chair having seatrest, footrest, and backrest which are adjustable to either a sit-up or a lie-down position or any selected intermediate position, with the entire chair being also adjustable to recline rearwardly at a selected angle. All of the adjustments can be made manually by the occupant while reclining in the chair. The mechanism also includes compensating means to avoid or minimize any influence by a selected adjustment upon a non-selected adjustment. None of the adjustments results in any significant raising or lowering relative to the floor surface of the combined center of gravity of the chair and its occupant, and therefore, in reversing any of the adjustments the occupant is spared the physical work that would be involved in raising the center of gravity.

43 Claims, 23 Drawing Figures

24a
12a
22a
10b
88a
170a
16a
148a
82a
81
C
G
180a
18a
A
10a
62a
188a
14a
30a
31
33
61
72b
71
20a
75
50a
B
11
50b
10b
61
50a
71
B
180a
G
10a
A
81
C

Fig. 21.
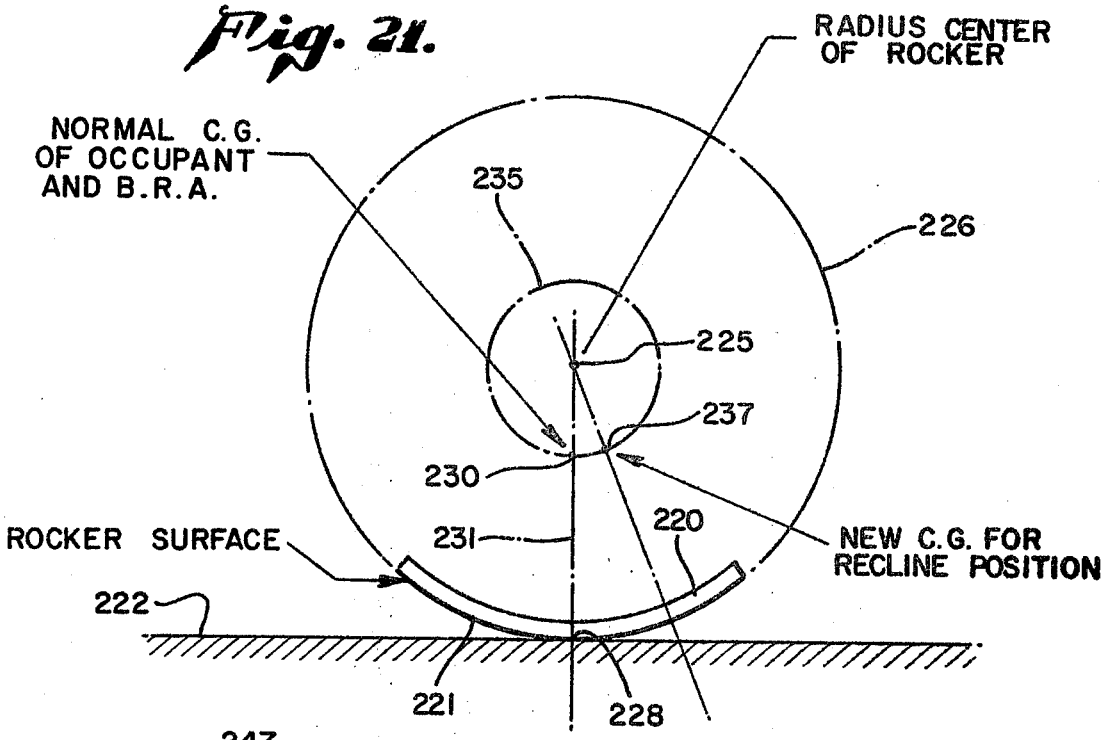
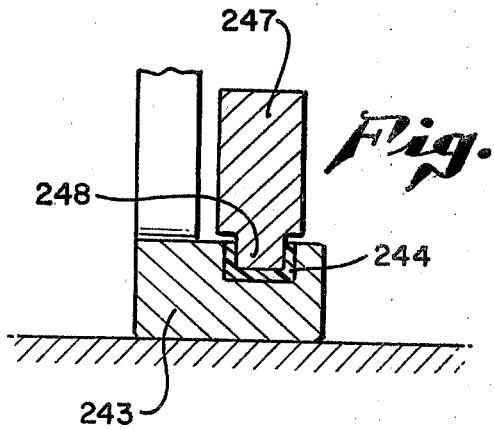
Fig. 23.
Fig. 22.
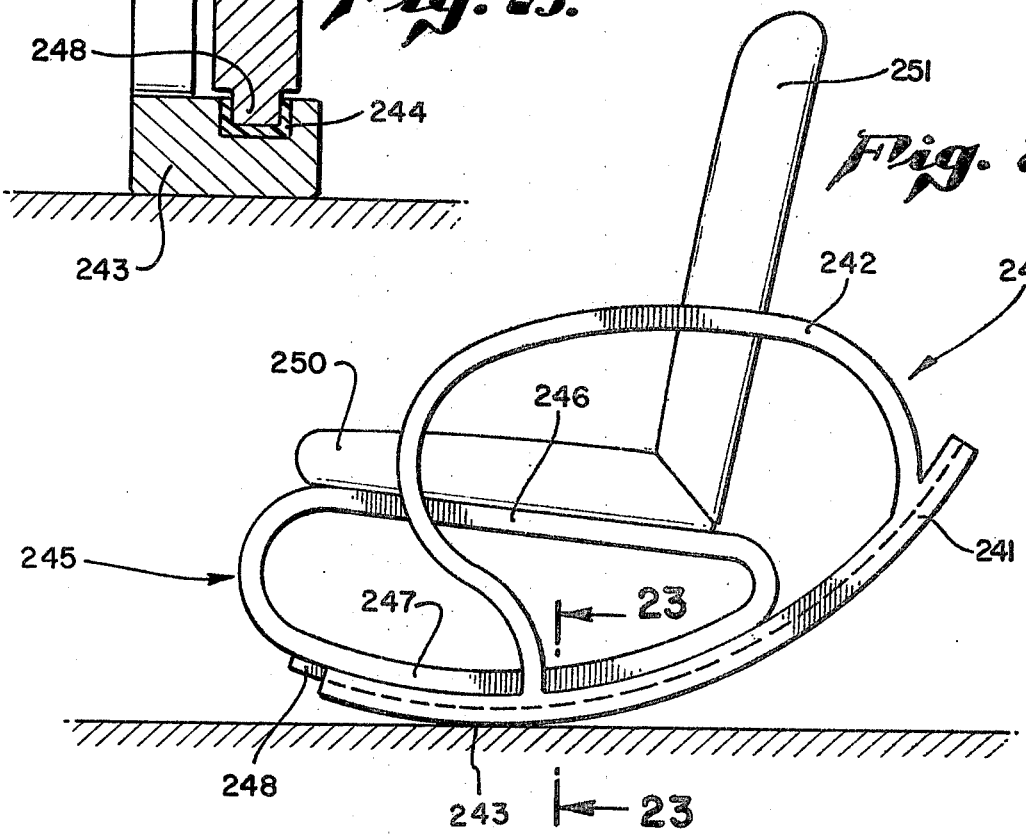

CHAIR UNIVERSALLY ADJUSTABLE BY OCCUPANT RECLINING THEREIN, AND METHOD

BACKGROUND OF THE INVENTION

Among the major deficiencies of previously known adjustable chairs are the following: (1) The use of stepwise adjustments rather than continuous adjustments; (2) The limited ranges of adjustability; (3) The fact that making a desired adjustment often causes another adjustment, undesired, to occur; and (4) The necessity for the occupant of the chair to move himself from the chain in order to make desired adjustment in the chair position.

It is therefore the object and purpose of the present invention to provide a fully adjustable reclining chair, preferably incorporated into a rocker, which may conveniently and easily be adjusted by the occupant while he is in the chair and without the necessity of disturbing his position of relaxation.

SUMMARY OF THE INVENTION

The present invention provides a number of significant improvements in the art of adjustable reclining chairs.

According to one concept of the invention a footrest, seatrest, and backrest are pivotally coupled together in series to provide a body rest assembly. Friction brake means are provided at both of the pivot joints. The occupant of the chair may therefore grip the side arms of the chair and manipulate his body to a desired position to relax and the body rest assembly will adjust its position accordingly. The resulting relative positions of the chair parts are then maintained by the static position of the occupant's body with the aid of the friction brakes.

According to a second concept of the invention a front suspension is provided underneath the forward end of the seatrest and a rear suspension is provided at a mid-point along the length of the backrest, preferably on a pivot axis which is about nine or ten inches from its lower end. Means are provided for adjusting the horizontal distance between front and rear suspensions whenever the angular position of the backrest changes. With this mode of support, the occupant of the chair may change from a sit-up to a lie-down position, or vice versa, and since his body rotates about an axis which is very close to its own center of gravity, the composite center of gravity of his body and body rest assembly is not significantly raised or lowered.

A third concept of the invention is particularly applicable to a rocking chair. The backrest suspension is made fixed relative to the rocker frame, while the front suspension is adjustable in a fore and aft direction. When the occupant of the chair changes between sit-up and lie-down positions, the composite center of gravity of his body and the body rest assembly does not move significantly in either a forward or rearward direction, and th dynamic equilibrium position of the rockers is not disturbed.

A fourth concept of the invention also applies specifically to a rocking chair. The backrest is made horizontally slidable fore or aft, on the rear suspension. A linkage is provided between the footrest and the backrest so that downward pivoting of the footrest causes the backrest to slide forward relative to the rear suspension. As a result, the dynamic equilibrium of the rockers is not disturbed.

A fifth concept of the invention also applies specifically to a rocking chair. The reclining adjustment is accomplished by moving the composite center of gravity of the chair occupant and body rest assembly along an arcuate path which is substantially concentric to the floor-engaging surfaces of the rockers. As a result, the composite center of gravity is neither raised nor lowered by either making or reversing a reclining adjustment. Therefore, the occupant of the chair is spared the physical work that would be required in raising the center of gravity, if it had previously been lowered.

According to a sixth concept of the invention, a footrest suspension is provided in which a cam cooperates with a holding spring for limiting the load upon the spring as the footrest approaches the downward limit of its pivotal movements.

According to a seventh concept of the invention a convenient dial-controlled mechanism is provided for initiating the reclining adjustment of the chair, and which includes a gear train that provides a mechanical advantage to the chair occupant.

DRAWING SUMMARY

FIG. 21 is a schematic diagram illustrating the mathematical theory of the reclining adjustment;

FIG. 22 is a side elevation view of an alternate form of adjustable reclining rocking chair in accordance with the invention; and FIG. 23 is a cross-sectional view taken on line 23—23 of FIG. 22.

PREFERRED EMBODIMENT

(FIGS. 1-20)

Figures 1, 2:
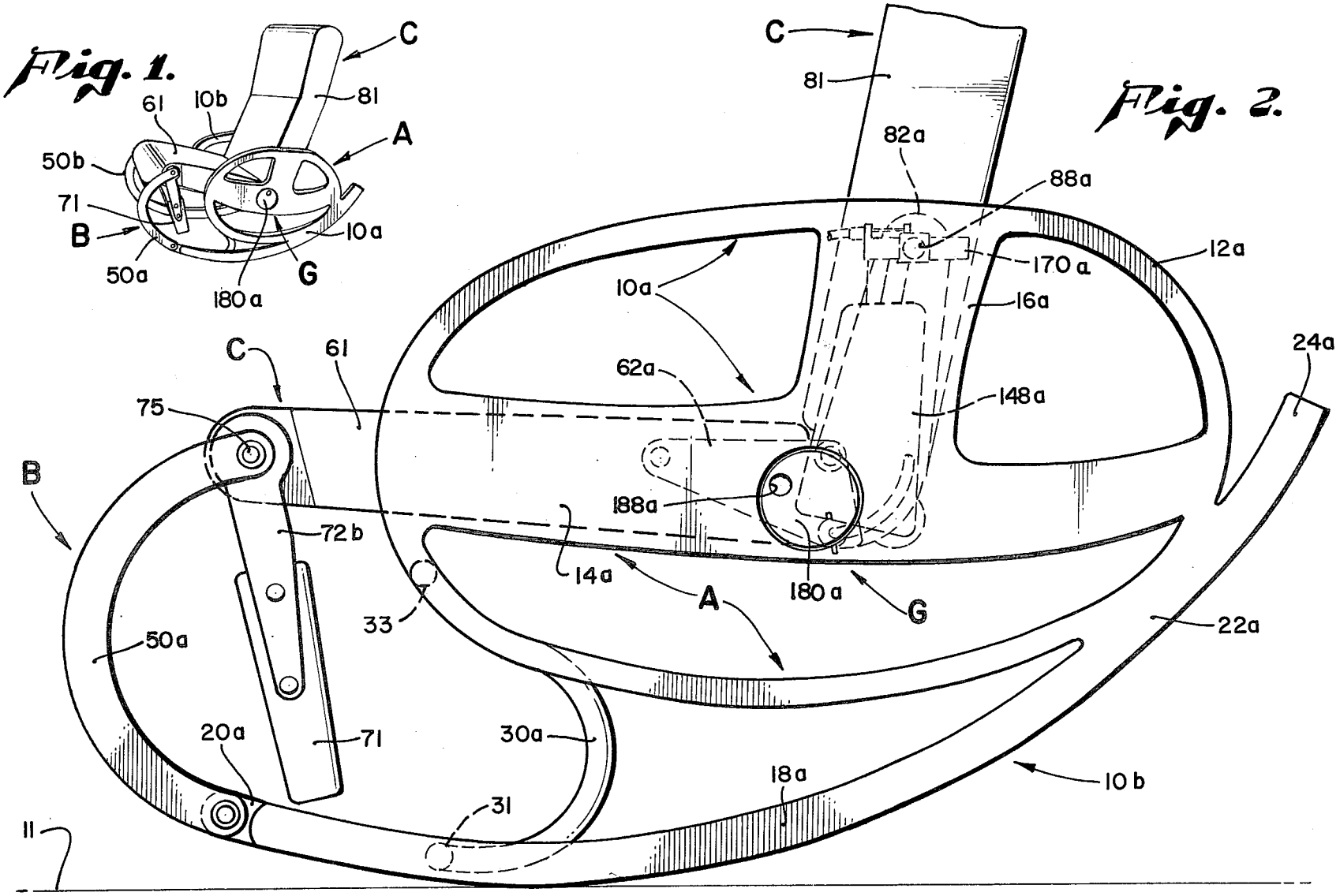
FIG. 1 is a perspective view of the chair of the present invention, in a sitting position with the footrest folded down.
FIG. 2 is a greatly enlarged side view of the chair in the same position as FIG. 1, the upper part of the backrest being omitted.

Reference is made to drawing FIGS. 1 through 20, inclusive, showing the presently preferred embodiment of the invention in complete detail. The two sides of the chair are completely symmetrical throughout, that is, the right-hand parts and left-hand parts are completely identical in some instances, while in other instances they are the mirror image of each other.

In the ensuing detailed description the symmetrical parts are given even reference numbers with *a* or *b* added to denote the left-hand and right-hand sides of the chair, respectively. Thus an arm portion on the left side of the chair might be designated 28*a* while its counterpart on the right-hand side would be designated 28*b*. Transverse crossbars and the like, which exist only in singular form, are assigned odd reference numerals.

In its overall arrangement the chair of the present invention includes rocker frame assembly A having two side frame held together by crossbraces, each side frame including both a curved rocker beam and an arm. Front suspension B includes a pair of vertically extending arms or braces whose lower ends are pivotally attached to the forward ends of the rocker beams. The upper ends of the vertical braces are used for pivotal attachment thereto of both the footrest and seatrest portions of the chair.

Body rest assembly C includes a seatrest, a footrest, and a backrest, each of generally rectangular configuration, with the rearward end of the footrest being pivotally secured to the forward end of the seatrest while the lower and forward end of the backrest is hingedly secured to the rearward end of the seatrest. The upper ends of the front suspension arms B are pivotally attached to the pivot joint connection between the footrest and the seatrest. This arrangement permits the forward portion of the body rest assembly to move horizontally, either forward or backward, relative to the rocker frame assembly which supports it. The backrest is also supported from the rocker frame assembly, but only at a mid-point along the length of the backrest. The support of the backrest is pivotal and is also adjustable in several ways. More specifically, in accordance with the present invention the vertical support is imparted to the backrest at approximately one-third of its length from its hinged lower end, and approximately two-thirds of its length from its upper end.

The pivotal relative movement of the backrest and seatrest is restrained by a backrest brake D. Pivotal movement of the footrest relative to the seatrest is restrained by another friction brake. A cantilever support is provided for the footrest, and a counterbalance spring mechanism is used to support at least most of the weight of the footrest. Thus the complete footrest suspension E includes both the counterbalance spring and the friction brake.

Rear suspension F includes like parts carried by the left and right rocker frames, pivotally supporting the backrest from both its left and right sides, as previously described. The rear suspension F includes a moderately complex mechanism and is adjustable in various ways and for various reasons. Recline adjustment mechanism G provides the input used in adjusting the position of the rear suspension.

The occupant of the chair may place the body rest assembly in either sit-up or lie-down position, or in any selected intermediate position, by gripping the chair arms and manipulating his body accordingly. The two friction brakes then assist in maintaining the selected position.

The chair of the present invention also includes a backrest-footrest linkage H which coordinates certain movements of the backrest and footrest relative to each other. This linkage includes a pair of flexible cables which extend underneath the seatrest, their forward ends being attached to the footrest while their rearward ends are attached to the rear suspension. This linkage causes the backrest to slide a short distance on the rear suspension, and it is brought into operation by the person occupying the chair, either by using his feet to pivot the footrest downward, or by gripping the chair arms and pushing the backrest rearward.

Before attempting to describe the operation of the chair in any greater detail it will now be helpful to describe in detail each of the major assemblies A through H, inclusive, which make up the complete chair.

ROCKER FRAME ASSEMBLY

(FIGS. 1-3, 5 & 8)

Rocker frame assembly A includes side frames 10*a*, 10*b* which are the mirror image of each other, each side frames being preferably integrally stamped or molded from either hard plastic or metal material. The left side frame 10*a* is seen in FIGS. 1-3 while the right side frame 10*b* is seen in FIGS. 5-8.

Figure 3:
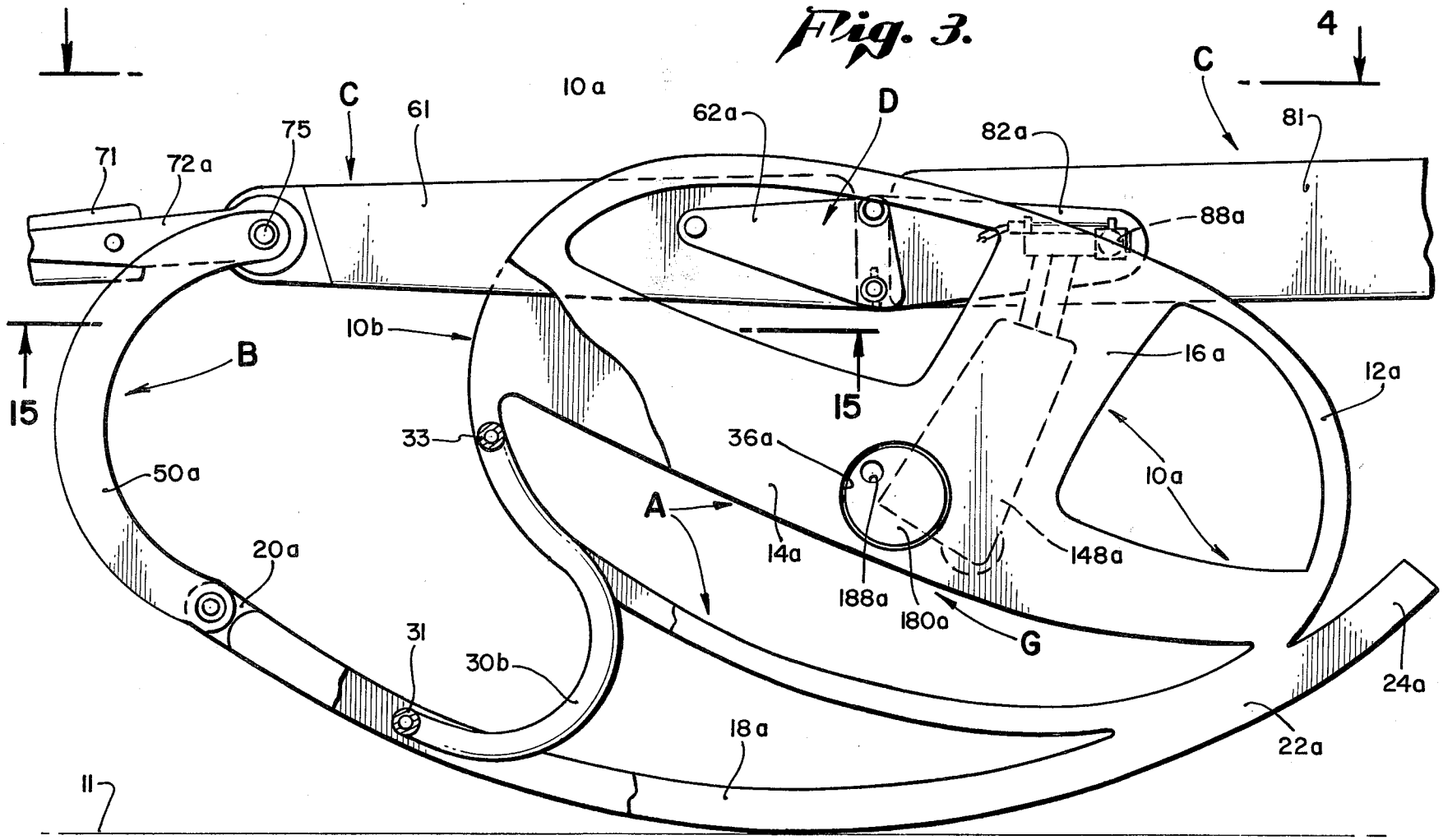
FIG. 3 is a side elevational view of the chair in a fully reclining position, shown partially in cross-section and with the protruding ends of the footrest and backrest being omitted from the view.

Referring specifically to FIGS. 2 and 3 it will be seen that the side frame 10*a* includes an elliptical rail 12*a* having its major axis substantially horizontal in FIG. 2 while in FIG. 3 its forward end is canted upwardly. A horizontal bar portion 14*a* of the side frame 10*a* extends along the major axis of the elliptical rail 12*a* and joins its two ends. A vertical bar 16*a* is attached to the crossbar 14*a* somewhat rearwardly of its longitudinal center, and extends vertically upward to join the rail 12*a* somewhat rearwardly of its longitudinal center. It will be seen that the bar sections 14*a* and 16*a* together form an inverted T-frame which is inscribed within the ellipse 12*a*.

Rocker beam 18*a* has a length approximately one and one-half times as great as the length of the ellipse 12*a*. The rocker beam is curved quite uniformly throughout its length and through a total angle of about 75°. A portion 22*a* of rocker beam 18*a* merges with the ellipse 12*a* just below the rearward end of horizontal bar 14*a*. The rearward extremity 24*a* of the rocker beam projects rearwardly of the ellipse and to an elevation slightly above that of the rearward end of the bar section 14a.

In FIG. 3 where rocker beam 18a sits substantially level upon floor surface 11 its forward extremity 20a is at almost as high an elevation as its rearward extremity 24a. The ellipse 12a including its longitudinal bar section 14a is then canted at an angle of about 30°. In other words, the ellipse 12a does not lie parallel to the rocker 18a but is inclined at an angle of approximately 30° relative to the rocker beam.

A hook-shaped brace 30a has its relatively curved end extending downward and becoming congruent with a portion of rocker beam 18a, the extremity of the curved end being captured on a tubular crossbrace 31. Tubular crossbrace 31 extends between the rocker beams 18a, 18b at a point approximately one-sixth of their length rearwardly of their forward extremities. The relatively straight and upwardly extending end of the hook-shaped brace 30a becomes congruent with a portion of the elliptical rail 12a. It is fastened to a tubular crossbeam 33. Tubular crossbeam 33 extends between the elliptical rails 12a, 12b just below the forward ends of the longitudinal bar sections 14a, 14b, respectively. It will therefore be seen that the hook-shaped braces 30a, 30b provide vertical support for the forward ends of the associated elliptical frame portions, relative to the forward ends of the associated rocker beams.

The apex of the T-frame has a circular hole 36a formed therein for receiving a finger-operated dial wheel that forms a part of the recline adjustment mechanism. See FIGS. 2 and 3.

Figure 5:
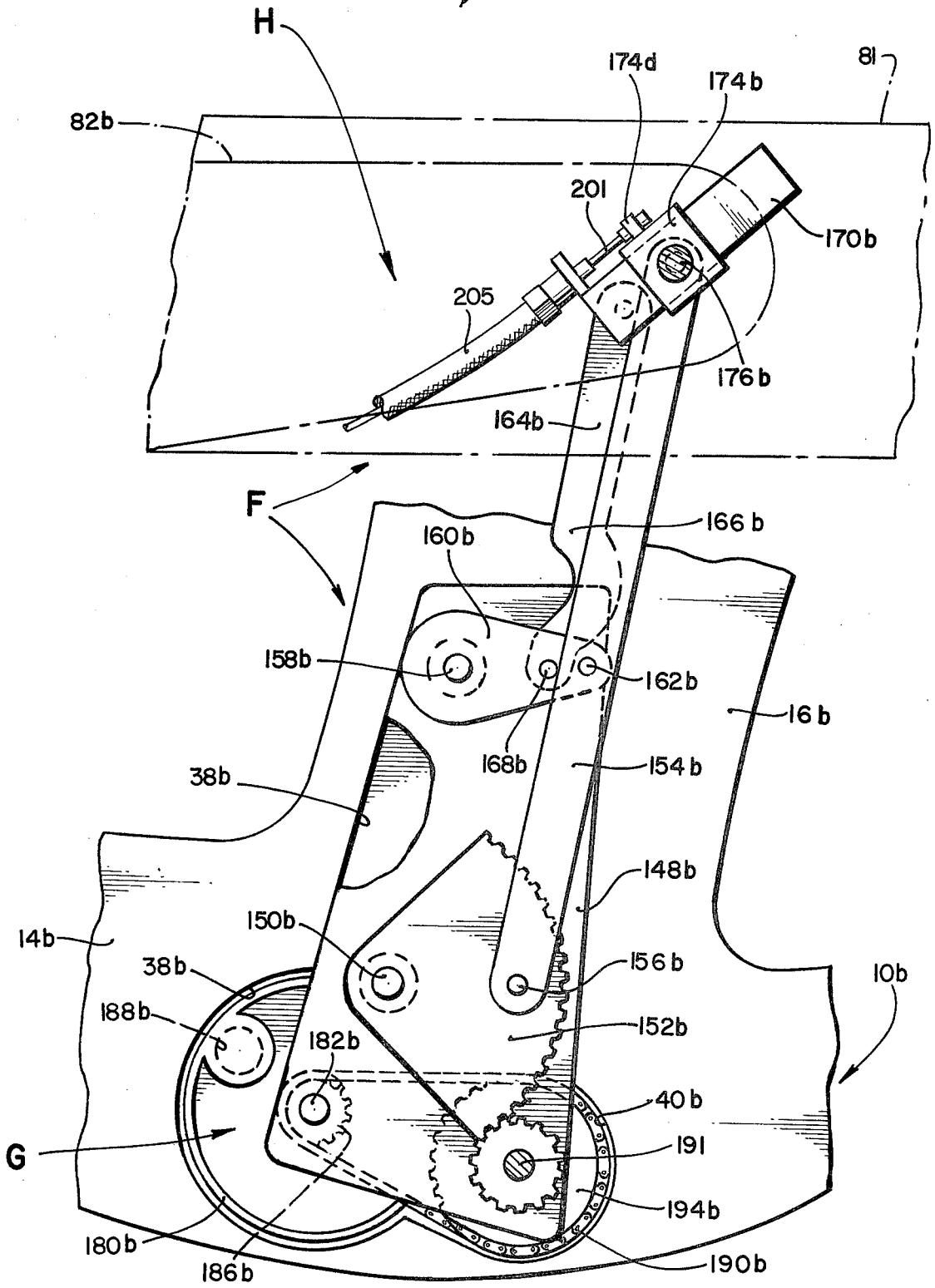
FIG. 5 is an elevational view of the right-hand portion of the rear suspension and its adjustment drive mechanism, taken on the line 5—5 of FIG. 4.
Figure 7:
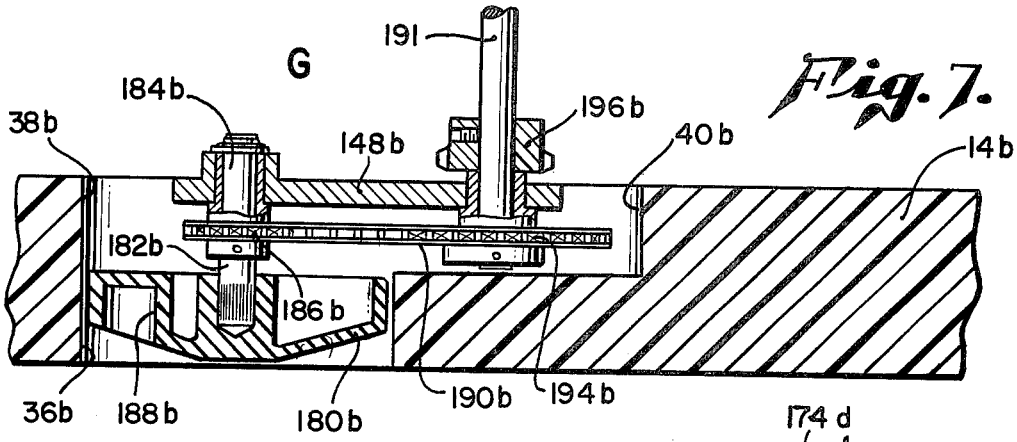
FIG. 7 is a cross-sectional view taken on line 7—7 of FIG. 6, showing the adjustment drive mechanism for the rear suspension.

As shown in FIG. 5 the side frame portion 14b, 16b has an internal recess 38b formed therein, the purpose of which is to receive a metal plate that constitutes a part of the rear suspension assembly. As shown in FIG. 7 the dial hole 36b merges into the plate recess 38b. It will also be seen from FIG. 7 in conjunction with FIG. 6 that plate recess 38b is also enlarged at 40b in order to receive additional portions of the recline adjustment mechanism for the rear suspension.

The lateral support of the two side frames is provided by a number of parts of the assembly. These include the cross-tubes 31 and 33, FIGS. 3 and 4; inclination shaft 191, FIG. 8; the pivot pins 176a, 176b, FIGS. 8 and 9; and the footrest pivot shaft 75, FIG. 15.

FRONT SUSPENSION

(FIGS. 2, 3, 15)

Figure 15:
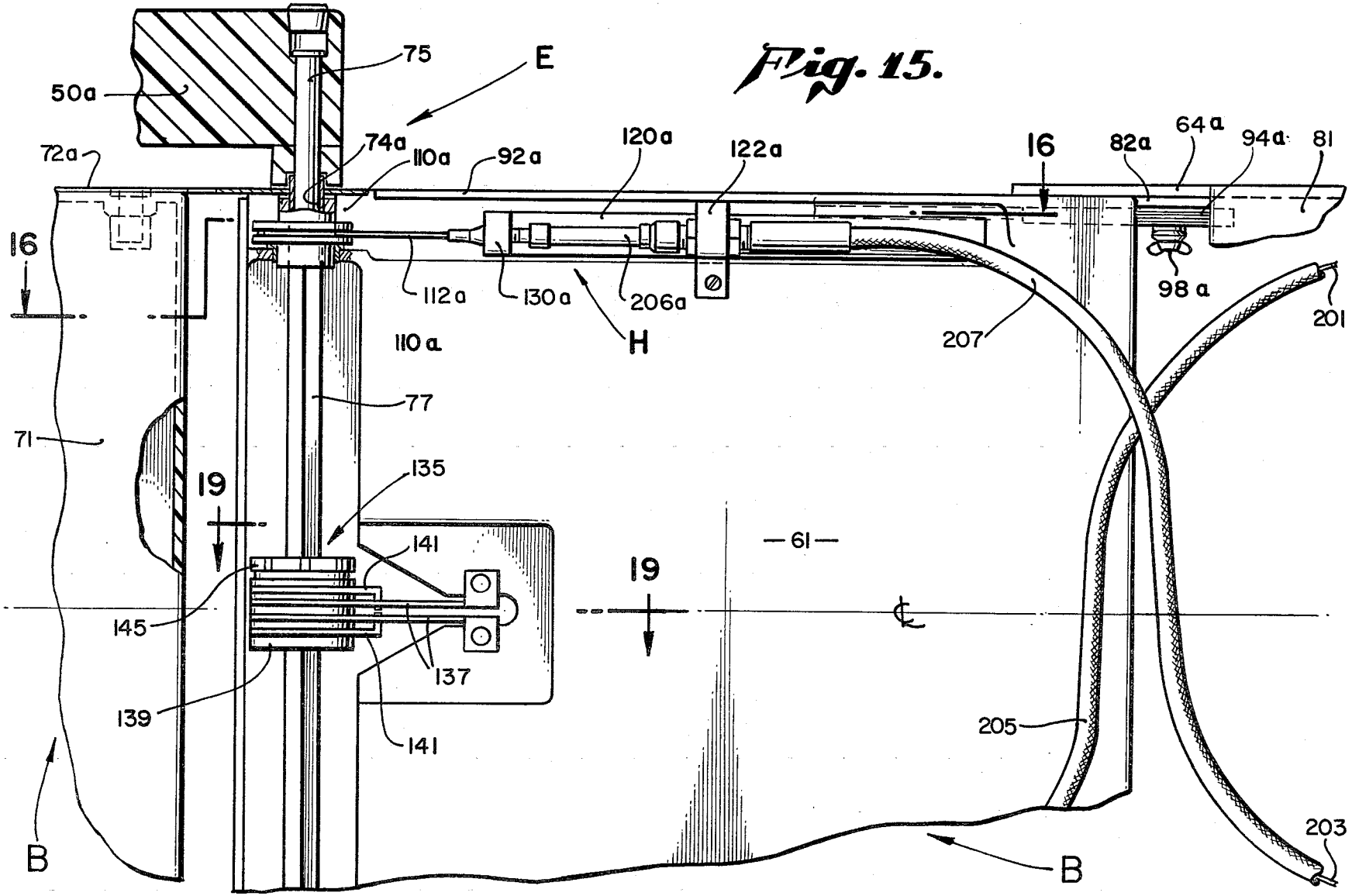
FIG. 15 is an underneath view of the body rest assembly taken on the line 15—15 of FIG. 3.

Front suspension B includes a pair of curved braces or arms 50a, 50b which are curved through an angle of about 135°. These braces are substantially vertically disposed with their rounded edge protruding forwardly of the chair, so as to essentially form an extension loop at the forward end of the rocker beams. The lower end of the curved brace 50a is pivotally attached to forward extremity 20a of rocker beam 18a, while its upper end as shown in FIG. 15 is pivotally attached to the footrest pivot shaft 75.

When the chair is placed in reclining position as shown in FIG. 3, i.e., the backrest is leaned back into substantially a common plane with the seatrest, the fact that the backrest is pivotally supported at a point other than its forward end makes it necessary that the seatrest move forwardly relative to the rocker frame assembly. Therefore, the upper end of seat braces 50a, 50b rotates forwardly relative to the rocker frame assembly.

BODY REST ASSEMBLY

(FIGS. 1–5, 8–16, 19, 20)

Body rest assembly C includes a seatrest 61 which is of generally rectangular configuration and is normally horizontally disposed. It also includes a footrest 71 which is of generally rectangular configuration and may be selectively rotated downwardly as shown in FIGS. 1 and 2, or disposed horizontally as shown in FIG. 3, or disposed in any selected intermediate position. The body rest assembly includes a backrest 81 which is of generally rectangular configuration and which may sometimes be nearly erect as shown in FIGS. 1 and 2 or may be horizontally disposed as shown in FIG. 3, or in any intermediate position.

It will later be described how, by operation of the recline adjustment mechanism for the rear suspension, the aligned body rest assembly including seatrest 61, footrest 71, and backrest 81 may be inclined somewhat rearwardly, so that the head of a person occupying the chair is at a lower elevation than his feet.

A parallel pair of metal hinge plates 62a, 62b are attached to the rearward end of the seatrest 61 on respective lateral sides. The shape of hinge plate 62b is best seen in FIGS. 11–14. It is substantially triangular in configuration with its narrow end being pointed forwardly and its upper longitudinal edge 64b being parallel to and slightly below the upper surface of the seatrest 61. The rear upper corner 66b of hinge plate 62b supports the backrest hinge, while the rear lower corner 68b supports the backrest brake, as will be subsequently described.

Figure 11:
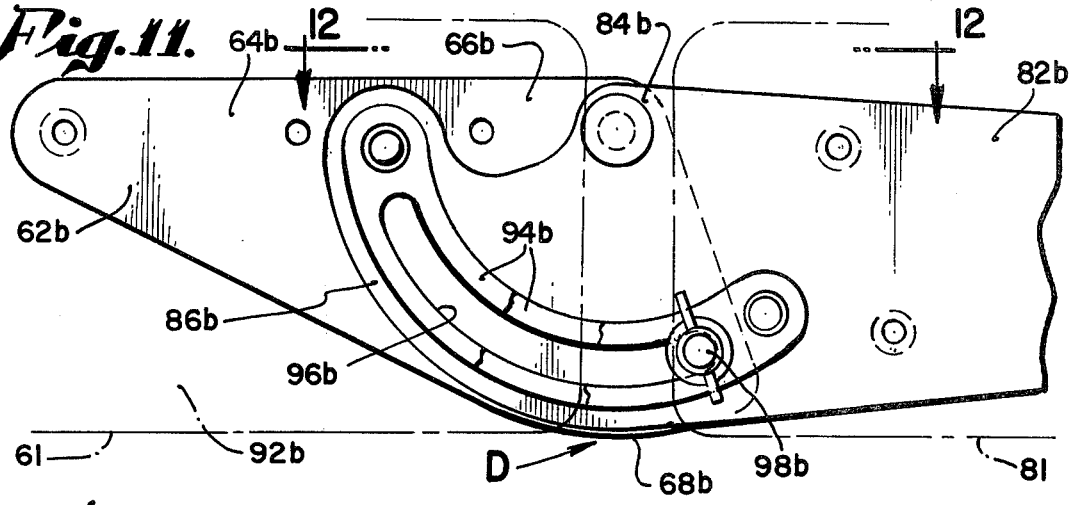
FIG. 11 is an interior view of a portion of the body rest assembly, taken on the line 11—11 of FIG. 4.
Figure 12:
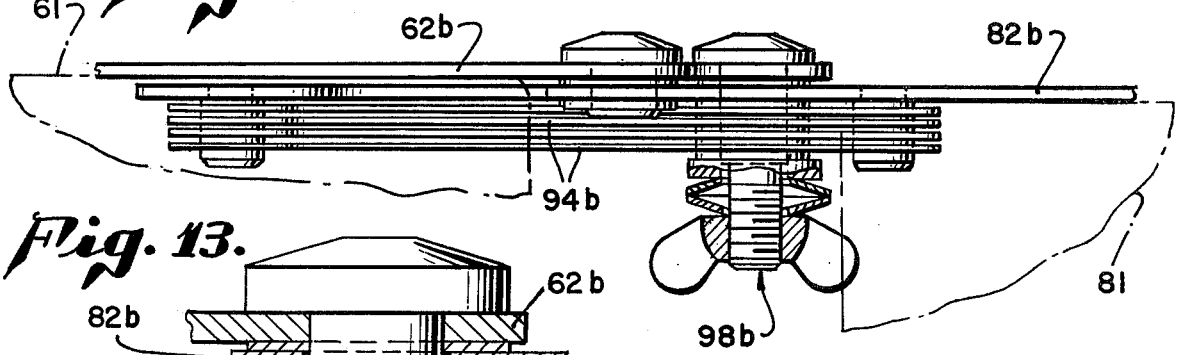
FIG. 12 is a top plan view of the backrest hinge and brake mechanism taken on the line 12—12 of FIG. 11.
Figure 13:
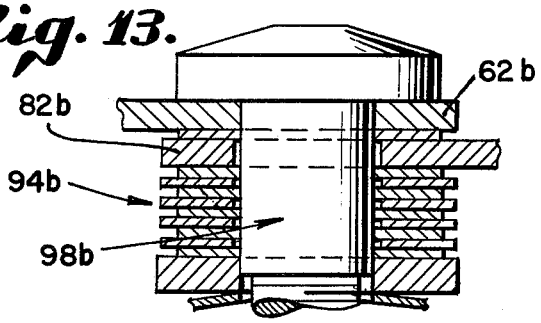
FIG. 13 is an enlarged detail view of the brake mechanism of FIG. 12.
Figure 14:
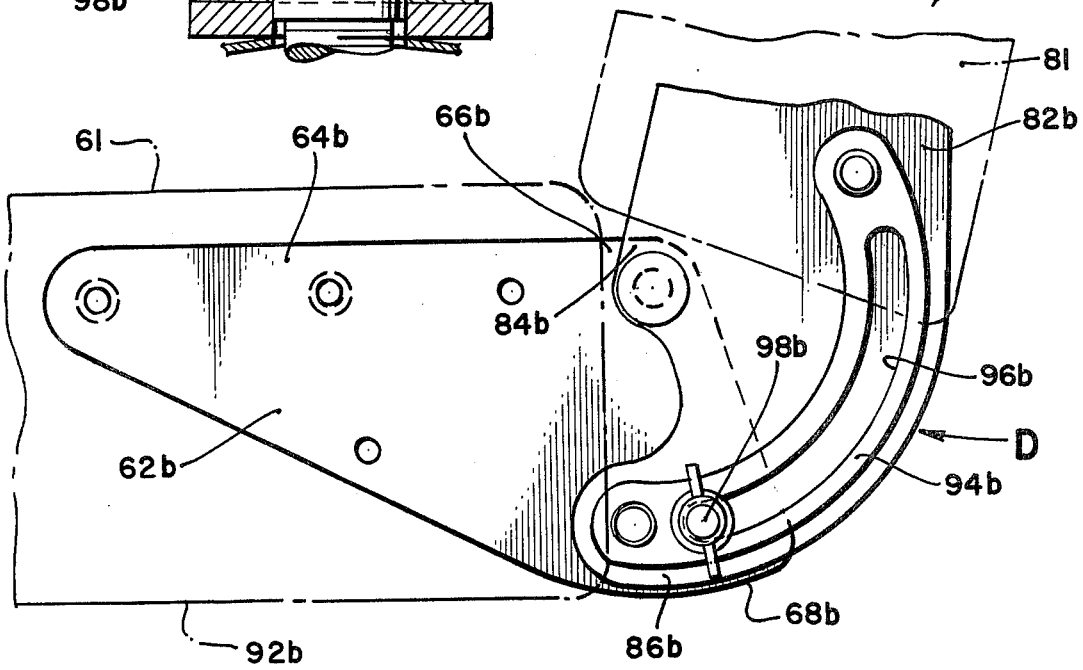
FIG. 14 is a view like FIG. 11 but showing the backrest in its raised position.

Backrest 81 also has a parallel pair of metal hinges 82a, 82b which are attached to its lateral sides at its forward or lower end. As shown in FIG. 11 the forward and upper corner 84b of hinge plate 82b forms a part of the backrest hinge connection. The forward and lower corner has an arcuately curved extension portion 86b forming part of the mechanism for the backrest brake, as will be described subsequently.

Thus it will be seen that the rearward end of seatrest 61 is hingedly attached to the forward end of backrest 81, by means of rivets, bolts, or the like which pivotally support the hinge plate corners 66a, 84a and 66b, 84b, respectively. It therefore follows that the backrest is free to move in a pivotal movement relative to the seatrest, unless that action is inhibited either by the backrest brake, or the body of the occupant of the chair, or the cooperative action of both.

Figure 8:
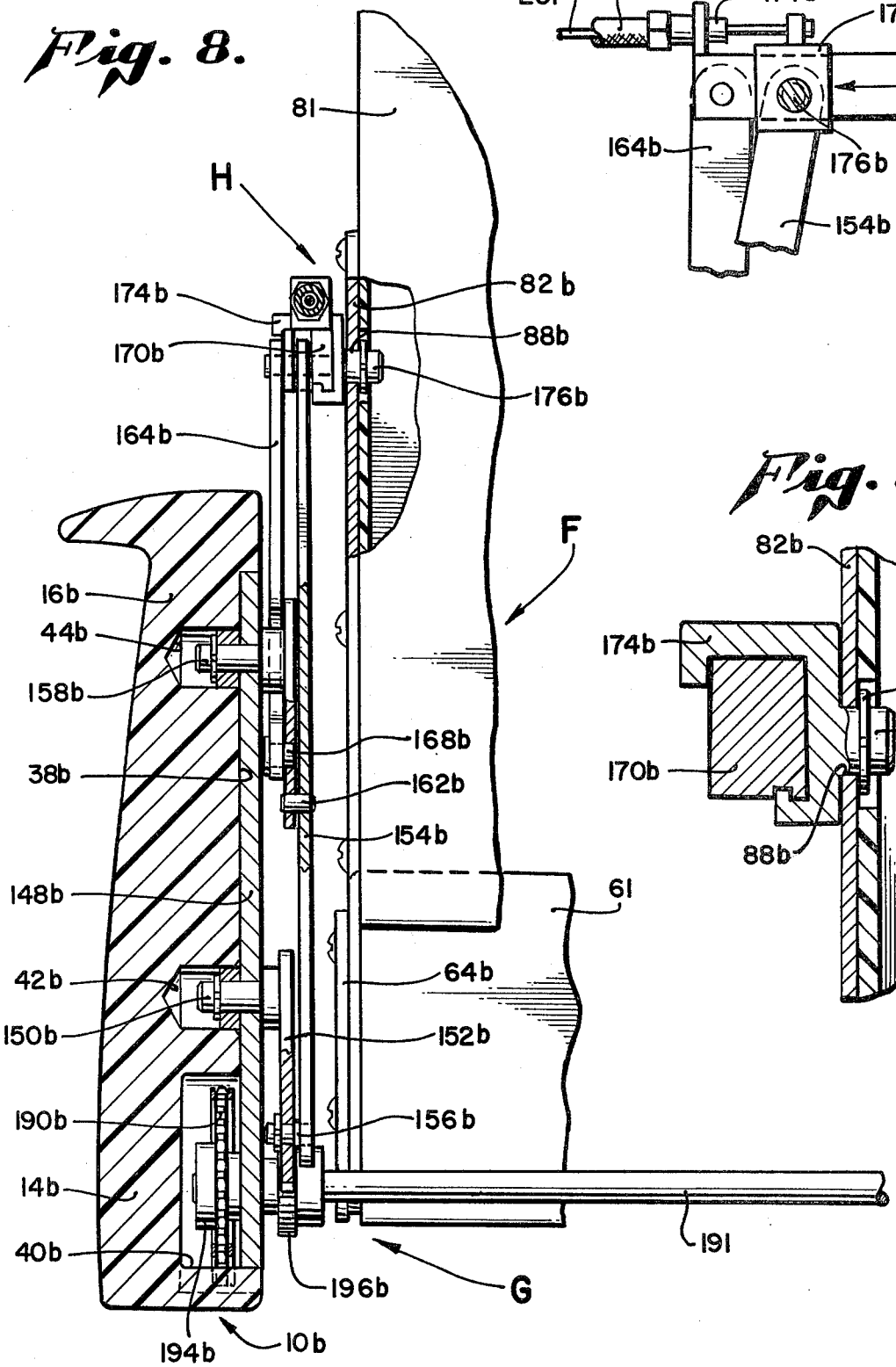
FIG. 8 is a cross-sectional elevational view of a right-hand portion of the chair taken on the line 8—8 of FIG. 6 showing the rear suspension and its adjustment drive mechanism.
Figure 10:
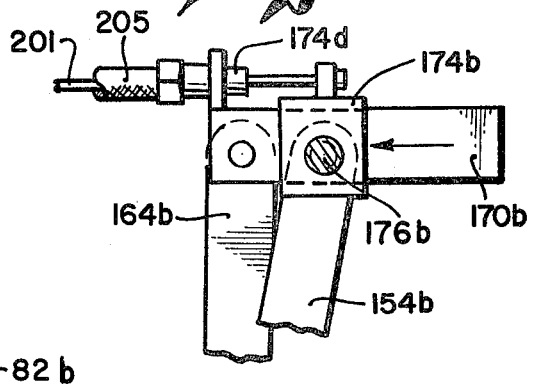
FIG. 10 is another detailed view of the rear suspension showing yet a different position of adjustment.
Figure 9:
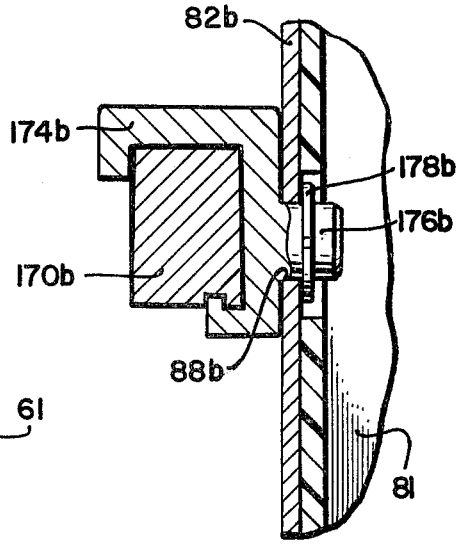
FIG. 9 is a detailed view of the rear suspension taken on the line 9—9 of FIG. 6.

The backrest hinges have a considerable length extending a considerable distance rearward or upwardly along the length of the backrest. See FIG. 4. The rearward end portion of the backrest hinge plate 82b is shown in FIGS. 5, 8 and 9. A suspension hole 88b is formed in the plate 82b, being located about one-third of the length of the backrest from its forward or lower end, and about two-thirds of the length of the backrest from its upper or rearward end. An identical suspension hole 88a is formed in the backrest hinge 82a. These holes receive suspension pins, FIGS. 4, 8 and 9, for supporting the backrest and hence the entire rearward portion of the body rest assembly. Suspension pins 176a, 176b are described in conjunction with rear suspension F.

Footrest 71 has a pair of straight metal side brackets 72a, 72b which are fastened to it. The rearward ends of these brackets have square holes 74a, 74b, respectively.

Figure 16:
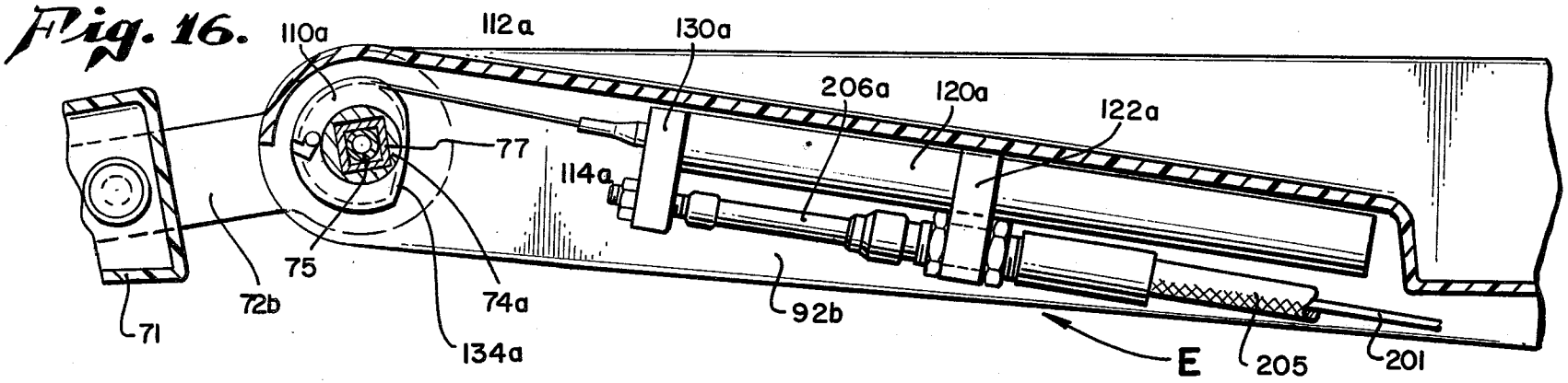
FIG. 16 is a cross-sectional view of the spring counterbalance mechanism for the footrest, taken on the line 16—16 of FIG. 15.
Figure 19:
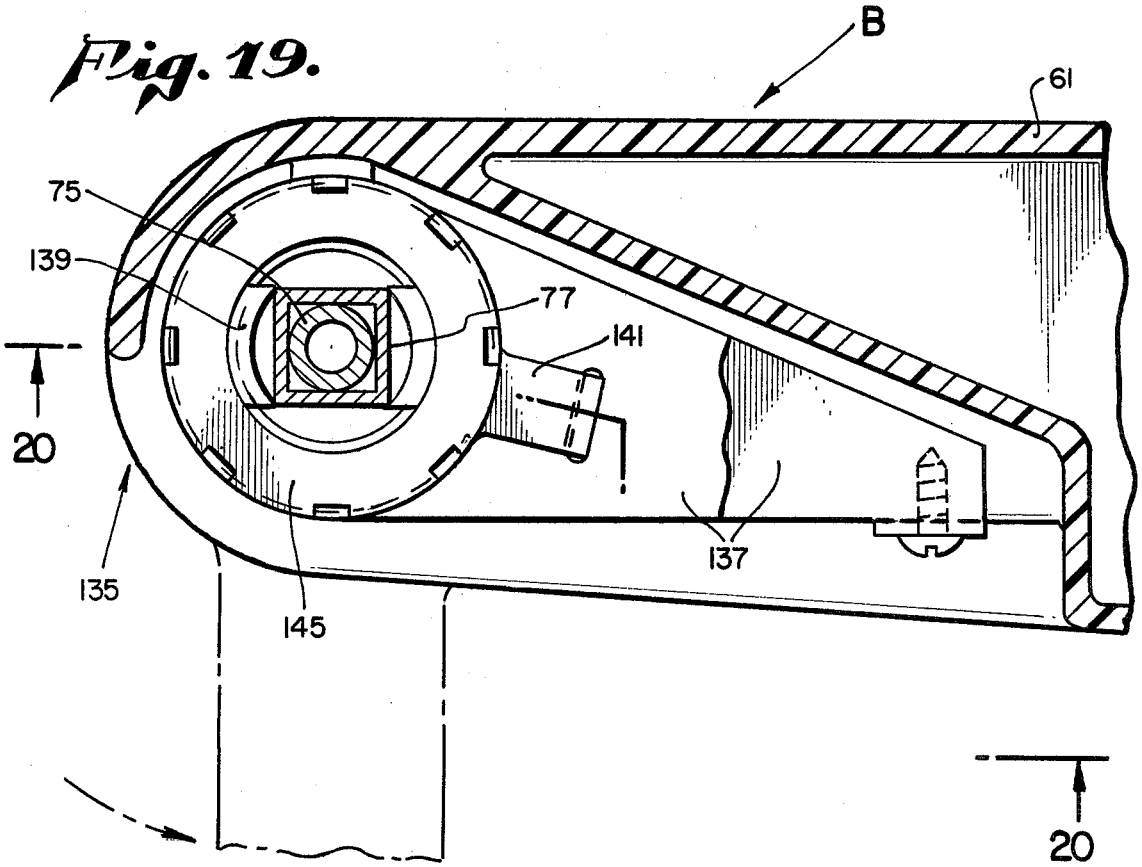
FIG. 19 is a cross-sectional elevational view of the friction brake portion of the footrest suspension, taken on the line 19—19 of FIG. 15.

A square footrest cam shaft 77 is received in these square holes. As best seen in FIGS. 15, 16, and 19 the round pivot shaft 75 extends through the interior of cam shaft 77 and projects from both ends thereof. The projecting ends of pivot shaft 75 are pivotally received in the upper ends of seat braces 50*a*, 50*b* and cams 110*a*, 110*b* carried on respective ends of the cam shaft 77 are rotatably journaled in respective sockets in the lower forward corners of seatrest 61. Therefore, the raising or lowering of the footrest is controlled by rotation of the cam shaft 77.

Although not specifically described, the various hinge plates, brakets, and side plates are attached to the body rest member (seatrest, backrest, footrest) by bolts, rivets, or other appropriate fastening means.

BACKREST BRAKE

(FIGS. 11–14)

Backrest brake D includes a stack of arcuately shaped leaves 94*b* placed upon the inner surface of the backrest hinge portion 86*b*, and having their ends fastened down to the hinge plate. There is an arcuately curved opening 96*b* which extends through all of the leaves and also through the supporting portion of the hinge plate. An adjustable spring clamp 98*b* has one end secured in the lower corner of seatrest hinge plate 62*b*, extends through all of the openings 96*b*, and on its outer end has a clamping plate held by a spring which is in turn tightened by a wing nut. The adjustable clamp 98*b* may be tightened or loosened as desired in order to either increase or decrease the holding power of the backrest brake D.

The left-hand side of the chair also includes the same brake mechanism in which the parts are numbered 86*a*, 94*a*, 96*a*, and 98*a*.

FOOTREST SUSPENSION

(FIGS. 4, 15–20)

As previously described, a footrest shaft 75 is supported in the upper ends of the curved braces 50*a*, 50*b* which constitute the front suspension B of the chair. A square hollow cam shaft 77 is carried on the intermediate portion of shaft 75. The ends of cam shaft 77 are received in square holes in the side brackets of the footrest 71. Cams 110*a*, 110*b* carried near respective ends of cam shaft 77 are rotatably journaled in respective sockets in the lower front corners of seatrest 61. Thus a cantilever support is provided for the footrest, and the raising or lowering of the footrest is controlled by rotation of the cam shaft 77.

Footrest suspension E includes spring means associated with both ends of the cam shaft 77, for aiding and controlling the pivotal movement of footrest 71 relative to seatrest 61. The footrest suspension E also includes friction brake means located at the lateral center of the cam shaft 77, and which also aids or controls the pivotal movement of the footrest.

Figure 4:
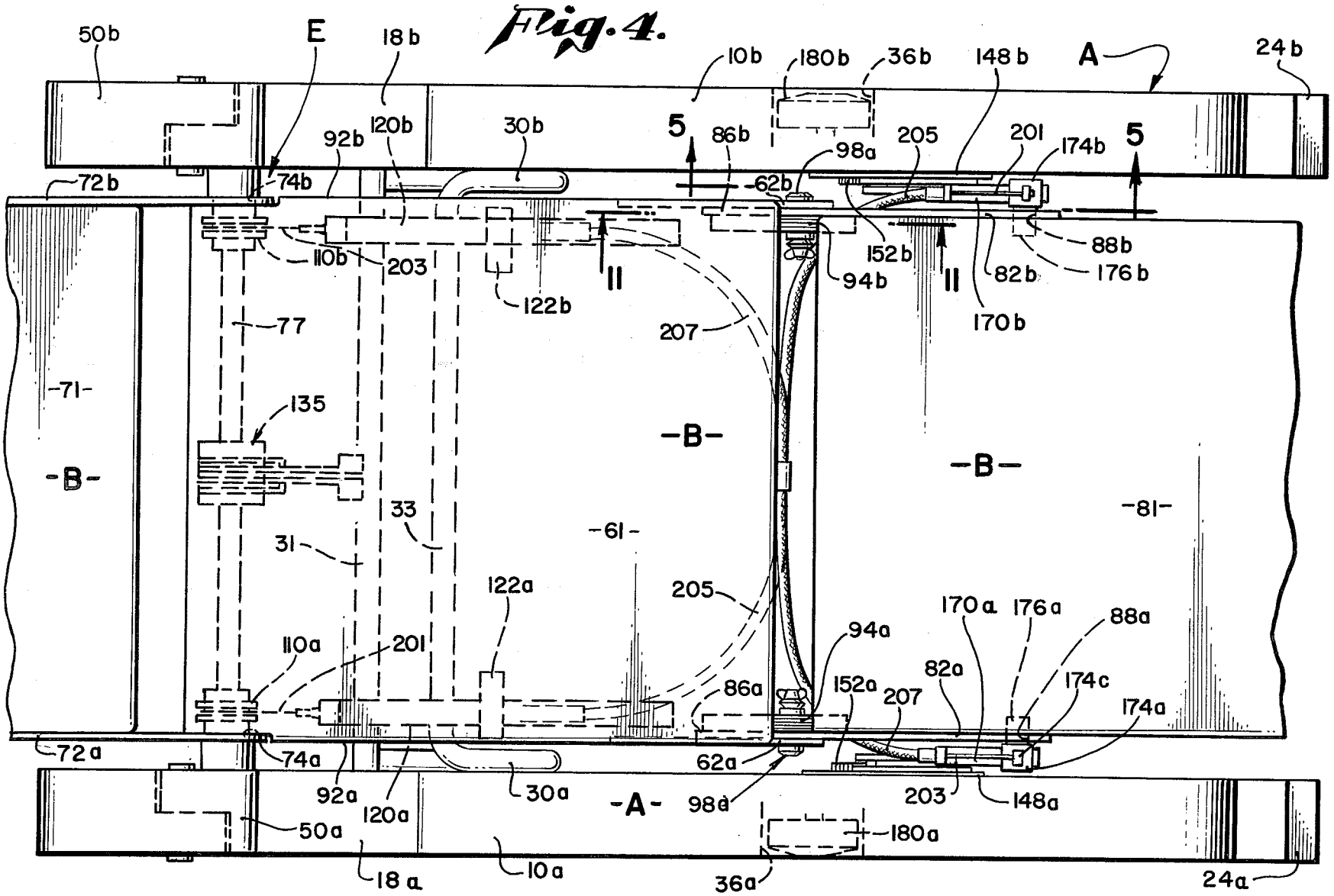
FIG. 4 is a top plan view of the chair taken on the line 4—4 of FIG. 3.

As seen in FIG. 4, a pair of cables extend underneath respective sides of the seatrest and then cross over each other before passing along the respective sides of the backrest, where they are attached to the supporting mechanism for the backrest. These cables are not part of the footrest suspension, however, but are a part of the backrest-footrest linkage H which is described in a later section of this specification. These cables 201, 203, throughout most of their length, are contained within housing or guides 205, 207.

Referring now to FIG. 15, it is seen that the left end of cam shaft 77 carries a cam 110*a* about which a short cable 112*a* is wound. Cable 112*a* is secured to one end of a plunger 114*a* (see FIG. 18). A piston head 116*a* is attached to the rearward end of the plunger. The plunger and piston head reciprocate within a spring housing 120*a*, which is in turn secured by bracket 122*a* in a fixed position to the side plate 92*a* of the seatrest. Thus as the footrest is raised or lowered, cable 112*a* either unwinds from or winds upon the cam 110*a*, and there is a corresponding longitudinal movement of the plunger 114*a* and its piston head 116*a* in a horizontal direction underneath the seatrest within the spring housing 120*a*.

Although the spring housing 120*b* and its associated spring mechanism and cable are not shown in detail, it will be understood that they are similarly constructed and located underneath the righthand side of the seatrest.

Figure 17:
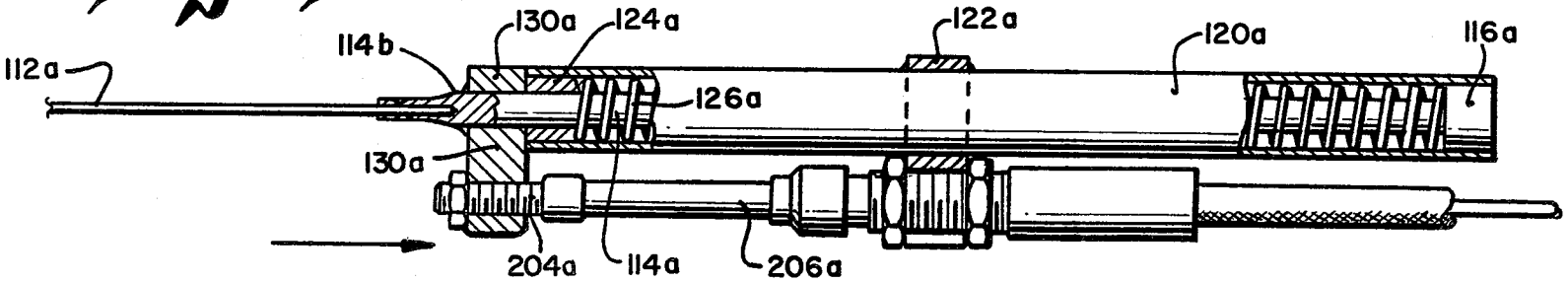
FIG. 17 is a view of the spring housing of FIG. 16, with parts cut away to show the compression spring inside.
Figure 18:
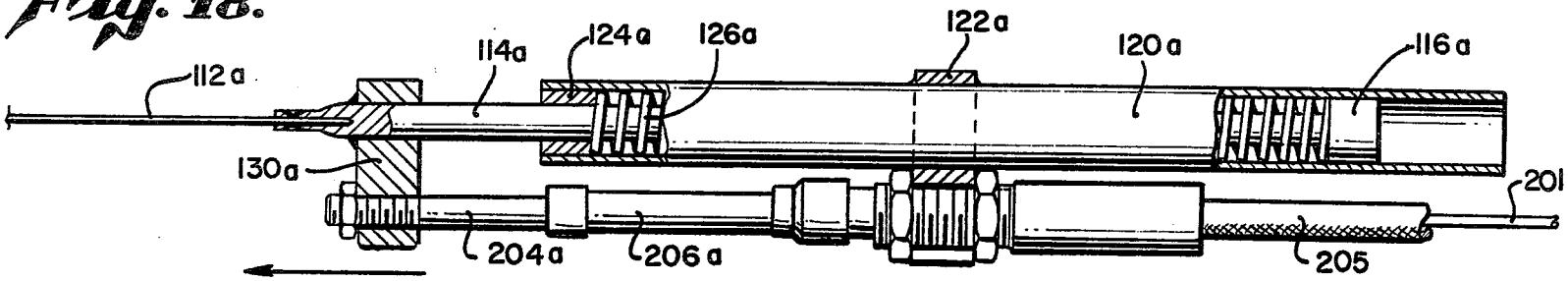
FIG. 18 is a view similar to FIG. 17 but showing how the spring is compressed when the footrest is in its lowered position.

A guide bushing 124*a* is fastened within the forward end of spring housing 120*a*. It permits a longitudinal sliding action of the plunger 114*a* and also restrains the forward end of a compression spring 126*a*, whose rearward end is confined by the piston head 116*a*. It will therefore be evident that when the footrest is lowered, spring 126*a* becomes compressed as shown in FIG. 18, and when the footrest is raised the spring expands to its normal full-length condition as shown in FIG. 17.

A movable bracket or stop 130*a* is fixedly attached to the forward end of plunger 114*a*. This bracket is, however, not an essential part of the footrest suspension E, but is utilized only in conjunction with the backrest-footrest linkage H, as will be subsequently described in a separate section of this specification.

The cam 110*a* is not entirely circular but instead has a reduced-radius or cut-away portion 134*a*, shown in FIG. 16. Pivoting or twisting the footrest downward causes the square ends and hence the entire shaft 77 to rotate, including its attached cams 110*a*, 110*b*. Each of the short cables 112*a*, 112*b* therefore winds up on its associated cam. When the footrest is inclined sharply downward, however, the short cable then rests upon the reduced-radius part of its associated cam member, and the force of the associated compression spring is not enough to pull the footrest back up, even though the spring is rather fully compressed. The easiest method then of raising the footrest is to utilize the backrest-footrest linkage, by moving the backrest rearwardly, as will be explained in the later section of this specification.

Figure 20:
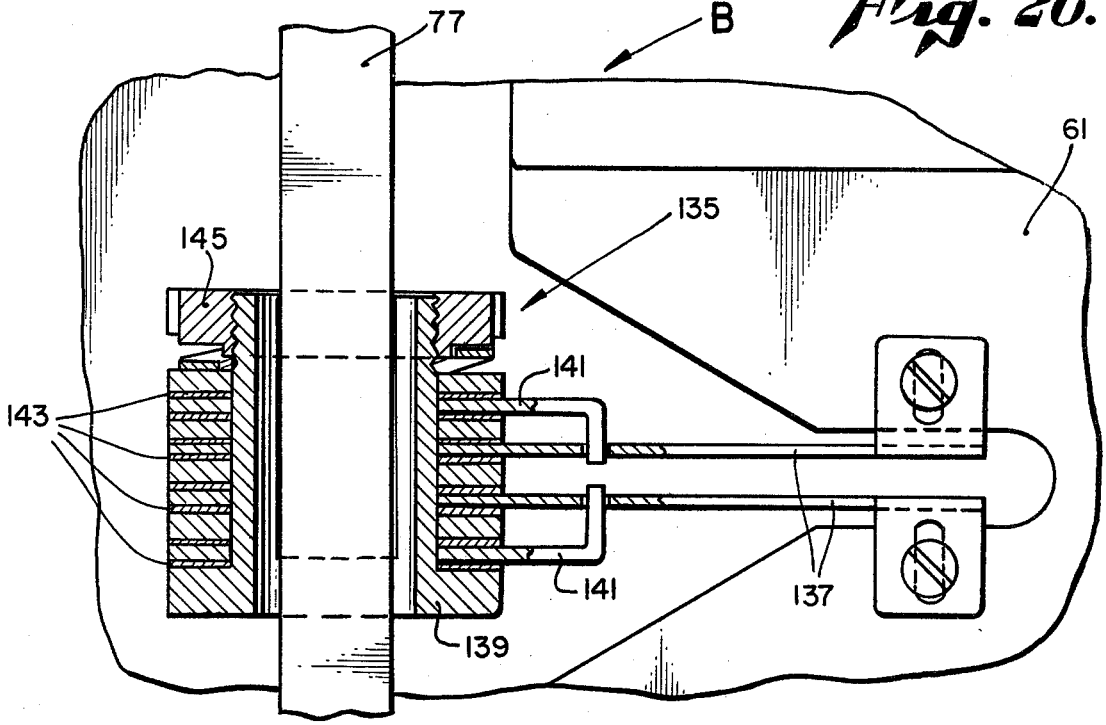
FIG. 20 is a longitudinal cross-sectional view of the footrest brake taken on the line 20—20 of FIG. 19.

The friction brake mechanism 135 is shown in FIGS. 15, 19 and 20. It includes arms 137 extending transverse to shaft 77. One end of arm 137 is secured underneath seatrest 61. The other end of arm 137 is rotatably supported on a nut 139 which surrounds and is keyed to the square shaft 77. One set of the friction leaves 141 on the nut are secured to arm 137 while another set of leaves 143 are keyed to the nut. A threaded cap 145 on the nut may be used to adjust the braking action.

REAR SUSPENSION

(FIGS. 4–10)

The mechanism which adjusts the reclining action of the chair is closely interrelated with the mechanism that suspends the rearward end of the body rest assembly. For convenience in description, however, the rear suspension F is considered as including only those parts which actually suspend or support the body rest assembly. The parts of the mechanism which have an adjustment function only are described in the next succeeding section of this specification.

A pair of metal base plates 148a, 148b are fitted into the inner sides of the T-frames of the respective rocker assembles. Thus as shown in FIGS. 5 and 8 the base plate 148b is fitted within the recess 38b that is provided for that purpose in the rocker frame portions 14b, 16b.

A gear sector 152b is pivotally attached by means of pivot shaft 150b to the base plate 148b. See FIGS. 5 and 8. A long arm 154b has its lower end pivotally attached at 156b to the gear sector, the gear sector then acting as a crank for raising or lowering the arm 154b.

Near the upper end of base plate 148b a crank 160b, which is of nearly triangular configuration, has its wide end pivotally attached by means of pivot shaft 158b to the base plate. The outer end of the crank is pivotally attached at 162b to the long arm.

A short arm 164b has a curved or crooked lower end portion 166b. The lower extremity of arm 164b is pivotally attached at 168b to the crank 160b. The radius distance along crank 160b for attachment of arm 164b is about two-thirds of the distance for attachment of arm 154b. In the position of the mechanism as shown in FIG. 5 the arms 164b and 154b are almost exactly parallel to each other.

Figure 6:
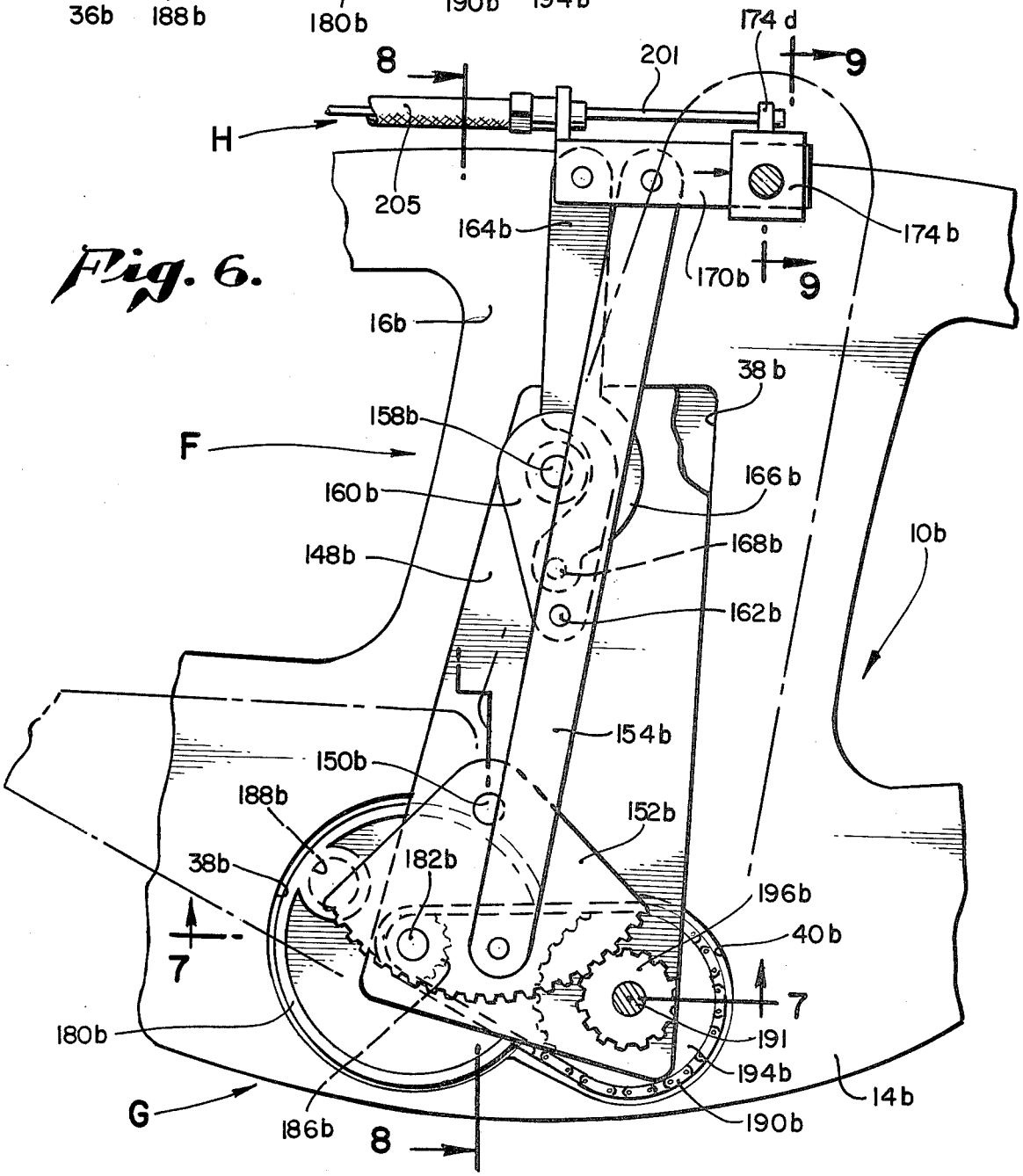
FIG. 6 is a view similar to FIG. 5 but showing the rear suspension in a different position of adjustment.

A horizontal link 170b is supported by the upper ends of both of the arms 164b, 154b. The attachment of the arms to the horizontal link is best seen in FIG. 6. Arm 164b is attached at the forward end of link 170b and arm 154b about one-third of the length of link 170b to the rear. A portion of link 170b is split or recessed so that the end of arm 154b is secured within the link (FIG. 8). In FIG. 5 the horizontal link does not appear to be horizontal, but to be inclined at an angle of about 45°; however, this action takes place when the rocker frame assembly is inclined about 45° rearwardly of its normal position, and hence the horizontal link remains substantially horizontal and substantially parallel to the floor surface upon which the rocker beams are supported.

A backrest block 174b is longitudinally slidable upon the horizontal link 170b, or alternatively, it may be considered that the horizontal link is slidable within the backrest block. Configuration of the block 174b is best seen in FIGS. 6 and 9. The backrest block 174b carries a pivot pin 176b which is formed integrally therewith. Pivot pin 176b is received within a circular opening 88b formed for that purpose in the side plate 82b of backrest 81. A retaining ring 178b secures the inner end of the pivot pin so that it will not become separated from the backrest.

Thus it is seen that the pair of pivot pins 176a, 176b support the backrest 81 along a horizontal axis which is about one-third of its length above its lower end, and about two-thirds of its length from its rearward or upper end. The pivot pins in turn are integral parts of the backrest blocks 174a, 174b. The blocks are slidably mounted upon the horizontal links 170a, 170b which remain generally horizontal, when the chair is not rocking, despite changes or adjustments that have been made in the angle at which the chair reclines rearwardly. The horizontal links in turn are supported by respective pairs of the vertical arms 154, 164 which have their lower ends indirectly attached to the base plates by means of the gear sectors and cranks.

RECLINE ADJUSTMENT MECHANISM

(FIGS. 4–10)

The recline adjustment mechanism G which is here described operates in conjunction with rear suspension F, described in the preceding section, for determining the extent to which the entire body rest assembly is moved rearwardly relative to the rocker frame assembly. Adjustment mechanism G is not used for the purpose of changing the angular relationship between seatrest 61 and backrest 81. That adjustment is accomplished by body manipulations of the occupant of the chair. Nor is the reclining adjustment G used for changing the angular relationship of footrest 71 relative to seatrest 61. That adjustment, also, is accomplished by body manipulation of the chair occupant.

Adjustment mechanism G includes a pair of finger operated dials 180a, 180b which are located in the exterior surfaces of the left and right sides, respectively. The location of dial 180a is best seen in FIGS. 2 and 3 of the drawings. Specifically, it is located within the recess 36a of the inverted T-Frame 14a, 16b of the lefthand side of the rocker assembly.

A relatively short dial shaft 182b has one end secured within the center of the plastic dial 180b (FIG. 7). The other end of shaft 182b is pivotally mounted by means of a journal or socket 184b in the base plate 148b. A sprocket 186b is carried on the dial shaft 182b near its longitudinal center. The circular dial 180b has an eccentrically located finger hole 188b which permits the dial to be conveniently rotated by the occupant of the chair, without the necessity of disturbing his body location. Rotation of the dial rotates the shaft 182b and hence the sprocket 186b.

An inclination shaft 191 (FIGS. 7 and 8) extends transversely across the entire chair, having its ends rotatably received in respective ones of the base plates. Each end of the shaft 191 also extends beyond the associated base plate and carries a sprocket wheel. Thus as seen in FIG. 7 the righthand end of shaft 191 carries a sprocket wheel 194b that is located within the recess 40b in alignment with the sprocket wheel 186b. A drive chain 190b drivingly couples the two sprocket wheels together.

Thus the hand-driven rotation of dial 180b causes the inclination shaft 191 to rotate. The diameter of sprocket wheel 194b carried on the inclination shaft 191 is several times as great as the diameter of sprocket wheel 196b carried on the dial shaft, thus providing a mechanical advantage to the operator. Rotation of one dial wheel also causes the other dial wheel to rotate in synchronism. To adjust the angle of recline of the chair, therefore, the occupant or user may operate the lefthand dial, or the righthand dial, or may operate both of them simultaneously, as preferred.

Inclination shaft 191 also carries a fixed gear wheel 196b which is just inside the base plate 148b, and which engages the teeth of gear sector 152b. Depending upon which way the dial is turned, the gear sector rotates either upward or downward. The identical gear sectors 152a, 152b on the opposite sides of the chair are driven in sychronism by the rotation of the inclination shaft 191.

Referring to FIGS. 6 and 5, an upward rotation of the gear sectors will be explained. Upward rotation of the gear sector 152b raises the long arm 154b. Because of the rotating or crank action, it also causes the lower end of arm 154b to move rearwardly. This movement of arm 154b, acting through the pivot joint 162b, causes the small end of crank 160b to be raised up from its downwardly extending position as shown in FIG. 6 to its horizontally rearwardly extending position as shown in FIG. 5. The upward movement of crank 160b also raises the short arm 164b. Thus both of the arms 164b, 154b are raised, but not by equal amounts. The result is that horizontal link 170b is moved from its horizontal position as shown in FIG. 6, to a more elevated position as shown in FIG. 5, and with its rearward end being canted upwardly relative to the rocker frame. There is also some rearward movement of the horizontal link 170b relative to the rocker frame.

More specifically, rotating the gear sector 152b in the upward direction causes the horizontal link 170b to move along an arcuate path which is approximately concentric to the arcuate path defined by the floor-engaging surface of the rocker beam 18b. The theoretical reason for this mode of adjustment will be described in a later section of this specification. When gear sector 152b is rotated downwardly, the link 170b moves in the reverse direction to resume its original position.

BACKREST-FOOTREST LINKAGE

(FIGS. 4–6, 10, and 15–18)

Linkage H couples the backrest 81 and footrest 71 operationally together, so that the positioning of one will affect the position of the other.

The main part of linkage H is a pair of cables 201, 203. See FIGS. 4 and 15. The forward end of cable 201 extends underneath the lefthand side of seatrest 61, as shown in FIG. 15. It is attached through a cable fastener 204a to the movable bracket 130a that was previously described in conjunction with the footrest suspension. See FIGS. 16–18. A guide tube 206a is rigidly supported from bracket 122a which is in turn supported from the side wall of the seatrest. Cable fastener 204a slides longitudinally within the guide tube 206a. A flexible cable housing 205 is attached to the rear side of bracket 122a and extends rearwardly, covering the cable 201 throughout most of its length.

As best seen in FIGS. 4 and 15, at the rearward end of seatrest 61 the cable 201 crosses from the lefthand side of the chair to the righthand side, and then extends up the righthand side of the backrest 81. The rearward end of cable sheath 205 is firmly secured to a bracket on the forward end of horizontal link 170b, as best seen in FIGS. 5 and 6. Cable 201 extends rearwardly to the backrest pin block 174b, and its rearward extremity is firmly secured to an upward projection 174b on the pin block.

Cable 203 is arranged in a similar manner. It extends underneath the righthand side of seatrest 61, being attached through a cable fastener 204b to movable bracket 130b. At the rearward end of seatrest 61 the cable 203 crosses laterally of the chair and then extends upwardly at the lefthand side of backrest 81, where its extremity is secured to an upward protrusion 174c of the backrest pin block 174a. See FIG. 4. Most of the length of cable 203 is covered by the flexible cable guide 207. The forward end of guide 207 is secured to bracket 122b underneath the seatrest while its rearward end is secured to a bracket on the forward end of horizontal link 170a.

It will therefore be understood that the flexible cable guides 205, 207 are effective for guiding the cables 201, 203, respectively, throughout the curved portions of their pathways. The guides also maintain a fixed pathway length for the cables to follow. Each cable has its forward end securely fastened to a movable bracket 130 underneath one side of the seatrest while its rearward end is firmly secured to a fixed bracket on the horizontal link 170 at the other side of the chair. As previously described in conjunction with the footrest suspension, the brackets 130 reciprocate horizontally in a forward or rearward motion as the footrest 71 is lowered or raised.

Therefore, each time footrest 71 is lowered, the cables 201 and 203 are pulled in a forward direction, causing the backrest pin blocks 174a, 174b to slide forward on the horizontal links 170a, 170b, respectively. The axis of the pins 176a, 176b from which the backrest 81 derives its vertical support is therefore moved forward relative to the rocker frame assembly. This movement will result either in raising the backrest to a more nearly vertical position, or in causing the front suspension braces 50a, 50b to pivot forwardly, or both, depending upon what other changes the occupant of the chair makes in his body position in conjunction with lowering the footrest. When the footrest 71 is raised, the reverse action occurs.

The movement of the linkage H is not necessarily initiated from the forward ends of the cables 201, 203, but may instead be initiated from their rearward ends. The occupant of the chair may grip the chair arms, i.e., the upward and forward portions of ellipses 12a, 12b. Using this grip on the arms of the chair he may then either pull himself forward, or push himself backward. If the movement is a forward pull, backrest pin blocks 174a, 174b slide forward on the horizontal links 170a, 170b, and footrest 71 pivots downwardly. If the movement is a rearward one, then the pin blocks slide rearwardly on the horizontal links and the footrest is raised.

The linkage cables 201, 203 pass through the transverse axis of pivotal motion of the backrest relative to the seatrest. Therefore the effective length of these cables remains the same regardless of the angular position of the backrest. The reason for crossing these cables over each other is to avoid too sharp a bend at the pivot axis.

MATHMETICAL THEORY

The theory of the invention is discussed with regard to a reclining chair occupied by a person who desires to make adjustments in the reclining position of the chair, without disturbing his position of relaxation in order to accomplish the adjustments.

Adjusting the positions of the adjustable parts of the chair involves raising or lowering them, and when a chair part is being raised it is necessary to perform physical work in order to do so. If too much weight is to be raised too far, it then becomes impossible or at least inconvenient for the chair occupant to accomplish the adjustment while still in his reclining position. It is also true that the different portions of the person's body have weight, and the different parts will in general be raised or lowered concurrently with the chair parts upon which they are supported. Hence the problem of having to raise considerable weight against the force of gravity results to some extent from the adjustability in the positions of the chair parts and to a greater extent from the weight of the body of the occupant himself.

Thus even when the chair is not supported by the rockers, it is important to minimize any vertical movements of the composite center of gravity of the movable chair parts and the body of the occupant. It will therefore be seen that the second concept of the invention, i.e., a pivotal support of the backrest at a mid-point along its length, is also useful in reclining chairs that are not equipped with rockers.

When the adjustable reclining chair is supported upon rockers the analysis of its operation becomes more complex. It is therefore helpful to augment the general discussion set forth above by pointing out that in the body rest assembly of the chair there are separate centers of gravity of the footrest, the seatrest, and the backrest. Furthermore, the body rest assembly as a whole has its own composite center of gravity which is not identical to any of the first three, but will in general lie somewhat above and towards the rearward end of the seatrest. However, the exact location relative to the seatrest of the composite center of gravity of the body rest assembly, will, of course, depend upon the particular angular positions of both the footrest and the backrest.

Carrying the analysis a step further, it will be realized that the rocker frame assembly has a particular center of gravity which is capable of being identified. The composite center of gravity of the body rest assembly will, in general, be at a significantly higher elevation than the center of gravity of the rocker frame assembly. The position of the seatrest relative to the rocker frame assembly may be varied or adjusted. Therefore, in general mathematical terms the conclusion is that the composite center of gravity of the body rest assembly taken as a whole may vary its position relative to the rocker frame assembly, and to the center of gravity thereof, depending upon the positions of adjustments assumed at a particular time by the various component parts of the body rest assembly.

It may be apparent that the performance of the rocking chair will be greatly affected by the locations of the various centers of gravity. When the chair is unoccupied it will assume a static position in which its total center of gravity, i.e., taking into account both the rocker frame assembly and the body rest assembly, is at the lowest possible elevation relative to the floor surface. The total center of gravity then lies upon a line which extends from the center of the radius of curvature of the floor-engaging surfaces of the rocker members in a vertically downward direction to the floor surface.

When a rocking action of the unoccupied chair is initiated, the period of time required for completion of one rocking cycle, i.e., both back and forth, is determined by the curvature of the rockers, the initial elevation above floor surface of the total center of gravity, and the moment of inertia of the entire structure. If the total center of gravity of the unoccupied chair were located at an elevation higher than the radius center of curvature of the rocker surfaces (which by definition it could not be) then the result would be that the chair would tip over and not complete even one rocking cycle. In general, therefore, the total center of gravity for the unoccupied chair (including both rocker frame and the adjustable body assembly) must lie a considerably shorter distance from the rocker surface than the radius of curvature of that surface. As typical figures, for example, the radius of curvature of the rockers might be 29 inches while the total center of gravity of the unoccupied chair is at a point 15 inches lower, or 14 inches above the floor surface when the chair is in its static balance position.

When the rocking chair is occupied it is then necessary to consider both the weight and the center of gravity of the body of the occupant. The center of gravity of the body of a human being, in general, lies on a horizontal axis passing laterally through the two hip bones. We have determined from observation and analysis that the location of this center of gravity does not depend very much upon the height, weight, age, sex, or unusual body configuration of the person. In view of this conclusion it is our belief that the optimum design and arrangement of an adjustable reclining chair, and particularly a rocking chair, is largely independent of the specific characteristics of the particular person who will use the chair.

In analyzing the occupied chair it is helpful to consider the composite center of gravity of the body rest assembly, i.e., seatrest, footrest, and backrest, together with the body of the person in his reclining position. This approach is convenient because adjustments in the body rest assembly produce adjustments in the position of the body of the occupant, and vice versa. Thus the overall position of the chair may be analyzed in terms of the center of gravity of the non-adjustable part, or rocker frame assembly, and the composite center of gravity of the adjustable parts, i.e., body rest assembly and body of occupant.

From the foregoing discussion the inherent difficulty of adjusting an adjustable reclining rocking chair should now be fully evident. If the person using the chair attempts to make adjustments in the positions of the various parts of the chair while he is not occupying the chair, it is then impossible to determine whether the proper result has been achieved. He can only test performance by getting into the chair and trying it out. On the other hand, if he remains in the chair, in his desired reclining position, while making the adjustments in the chair position, it then becomes essential to avoid significant vertical changes or movements in the composite center of gravity of the body rest assembly and occupant's body, because of the physical work that is required. It is true that the chair occupant may be quite willing to perform the necessary work or labor, but he is handicapped in doing so from a reclining position.

In conclusion, the chair should be so designed that adjustments in the body rest assembly may be made without significantly raising or lowering the composite center of gravity of the body rest assembly and body of occupant. Horizontal movements of the composite center of gravity in either a forward or rearward direction should not be permitted to occur incidental to adjustments in the body rest assembly, but only when it is desired to change the static balance of the chair as a whole in order to increase or decrease the angle at which the chair as a whole tilts rearwardly.

Another consideration arises when it is desired to change the angle at which the chair as a whole tilts back. The composite center of gravity of the movable portions of the chair, i.e., body rest assembly and body of occupant, must be consciously moved in either a forward or rearward direction. This movement changes the position of static balance of the chair, which was the desired result. But it could also change the elevation of the composite center of gravity of the movable parts, and that would be an undesired result.

FIG. 21 of the drawings illustrates the correct mathematical theory in accordance with the present invention for adjusting the reclining position of the rocking chair. Curved rockers 220 having floor-engaging surfaces 221 rest upon a flat floor surface 222. The radius center of curvature of the rockers is indicated by a point 225. Thus if the rockers 220 were extended they would form a perfect circle indicated by a dotted line 226.

The rockers 220 normally engage the floor surface at a single point 228 along their length. A point 230 represents the normal location of the composite center of gravity of the chair occupant and body rest assembly relative to the rockers 220. A dotted line 231 is a particular radius line for the radius of curvature of the rockers and extends vertically downward from the radius center 225 through the composite center of gravity 230 to the floor contact point 228.

A smaller dotted circle 235 is concentric to circle 226 and passes through the composite center of gravity point 230. Circle 235 represents the arcuate path along which the composite center of gravity should move when the angle of recline of the chair is to be changed. Thus as shown in the illustration the center of gravity may be moved rearward along the arcuate path 235 about 20° to the point 237, in order to cause the chair to recline about 20° rearwardly.

In the foregoing analysis of the rearward recline adjustment the effect of the center of gravity of the rocker frame assembly has been neglected. Typically, the rocker frame assembly may weigh about 20 pounds while the body rest assembly and the adjustable parts which support it may weigh about 25 or 20 pounds. The weight of the body of the chair occupant will typically be 150 pounds or perhaps 200 pounds or more. Hence the composite center of gravity of the body rest assembly and the chair occupant is the predominant consideration in determining the reclining action of the chair. If a more precise mathematical analysis were made, and the weight and center of gravity of the rocker frame assembly taken into account, then the desired path of movement of the composite center of gravity of occupant and body rest assembly would depart slightly from the arcuate path shown by the dotted circle 235. This difference, however, is of a small order to magnitude, much the same as the difference in angle of recline which results when the chair occupant shifts the position of his body upon the seatrest by a small amount, or bends his head and neck either forward or rearward.

ALTERNATE FORMS

As previously stated, the adjustable body rest assembly as disclosed in the present drawings, FIGS. 1 through 20, inclusive, is not restricted to use in conjunction with a rocking chair. It may also be advantageously utilized in a chair having a fixed and immobile base. Thus the pivotal support of both backrest and footrest from the seatrest, the use of separate friction brake means at each of the pivot joints, and the spring suspension of the footrest are features of the present apparatus which may be utilized effectively in a number of different types of adjustable chairs.

The technique of pivotally supporting the forward end of the seatrest on a front suspension, and pivotally supporting the backrest at a mid-point along its length on a rear suspension, also has utility independent of a rocking chair type of base. As previously pointed out, this feature of the apparatus permits pivotal adjustment of the backrest relative to the seatrest throughout a wide angular range, and without significantly raising or lowering the composite center of gravity of the body rest assembly and the body of its occupant.

The theory of the fifth concept of the invention has been discussed in conjunction with FIG. 21. Another apparatus for accomplishing this result is shown in FIGS. 22 and 23. A rocker frame assembly 240 has rocker beams 241 and curved arms 242 attached near the rearward end of the rocker beams and then curving upwardly, forwardly and downwardly to be attached to the rocker beams somewhat near the forward ends thereof. The chair frame 245 includes a straight upper beam 246 which normally extends horizontally and a curved lower beam 247 whose ends are curved upwardly to merge with the ends of the beam 246. A seatrest 250 is fixedly attached to and supported upon the chair beams 246. A backrest 251 is attached to the rearward end of the seatrest 250, and may be either fixed or pivotal thereon. Each rocker beam 241 has a laterally inwardly extending portion 243 (FIG. 23) and a U-shaped metal track member 244 is carried in the upper surface thereof. The lower chair frame beam 247 has a downwardly depending tongue 248 which rides within the channel member 244.

In operation, the chair frame assembly 245 and body rest assembly 250, 251 are carried upon the curved tongues 248, which in turn are slidably received within the channel irons 244. The chair occupant may grasp the forward portions of the arms 242 and use them as a means of pushing himself and the body rest assembly 250, 251 in either a forward or rearward direction. Since the composite center of gravity of the chair occupant and body rest assembly has a constant location relative to the curved tongues 248, and since the arcuate configuration of the tongues 248 is identical to that of the rocker beams 241, and slides therealong, the result is that the composite center of gravity is moved along an arcuate path which is substantially concentric to that defined by the floor-engaging surfaces of the rockers.

However, in spite of the similarity of the embodiment of FIGS. 22, 23 to the preferred embodiment of the invention, it does not produce an equivalent result in terms of the rearward tilting adjustment. In order to produce an equivalent result it would need to include additional suspension linkages between beam 246 and rocker 241, which may be accomplished in any one of several possible ways.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. An adjustable reclining chair comprising:

a support frame assembly including means providing front and rear suspensions;

a body rest assembly including a seatrest, a backrest, and means hingedly securing the rearward end of said seatrest to the forward and lower end of said backrest;

means pivotally supporting the forward end of said seatrest upon said front suspension;

means pivotally supporting said backrest, at a mid-point along the length thereof, upon said rear suspension; and the horizontal distance between said front and rear suspensions being easily adjustable;

whereby an occupant of the chair may manipulate his body and the body rest assembly between sit-up and reclining positions without substantially raising or lowering the composite center of gravity of his body and the body rest assembly.

2. A chair as in claim 1 which further includes braking means for restraining pivotal movement of said backrest relative to said seatrest.

3. A chair as in claim 1 which further includes a footrest extending forwardly of said seatrest, means pivotally securing the rearward end of said footrest to the forward end of said seatrest, and braking means for restraining pivotal movement of said footrest.

4. A chair as in claim 3 which further includes a spring counterbalance coupled between said seatrest and said footrest and operable for at least partially supporting the weight of said footrest.

5. A chair as in claim 1 wherein said support frame assembly includes a parallel pair of longitudinally rounded, upwardly convex arms disposed above the sides of the space normally occupied by said seatrest.

6. A chair as in claim 1 wherein said rear suspension includes a pair of substantially horizontal slide means, said pivotal support means for said backrest being slidably mounted upon said slide means for movement either forwardly or rearwardly relative to said support frame assembly.

7. An adjustable reclining chair comprising:

a rocker frame assembly;

a seatrest, a backrest, and a footrest pivotally coupled together in series and supported upon said rocker frame assembly;

means for adjustably varying the angular position of said footrest relative to said seatrest in a continuous rather than step-wise fashion, the angular position of said footrest being dependently responsive to movement of either said seatrest or said backrest;

means for adjustably varying the angular position of said backrest relative to said seatrest in a continuous rather than step-wise fashion, the angular position of said backrest being dependently responsive to movement of either said seatrest or said footrest; and means for adjustably moving said backrest in a direction longitudinally of said rocker frame assembly, in a continuous rather than step-wise fashion.

8. The chair of claim 7 which further includes coupling means, coupled between said backrest and said footrest adjusting means, for raising said footrest in response to a rearward movement of said backrest so that the center of gravity of a person occupying said chair is maintained in a substantially constant longitudinal position relative to said rocker frame assembly.

9. In a rocking chair, a rocker frame comprising:

a generally elliptical member disposed in a vertical plane with its major axis normally being nearly horizontal but raised somewhat at its forward end, the upper and forward portion of said elliptical member being adapted to serve as a chair arm;

a horizontal brace member disposed within said elliptical member in the plane thereof and extending between the ends of said elliptical member generally along the major axis thereof;

a vertical brace member disposed within said elliptical member in the plane thereof, extending from a mid-point of said horizontal brace member upwardly to the upper part of said elliptical member; and a curved rocker beam having a length of the order of one and one-half times the length of said elliptical member, disposed therebeneath and extending both forwardly and rearwardly thereof, said beam being secured to said elliptical member at a point just below the rearward end of said horizontal brace member.

10. The rocker frame of claim 9 which is integrally formed as a single part.

11. A rocker frame as in claim 10 which is made of rigid plastic material.

12. An adjustably reclining rocking chair comprising:

a pair of rocker frames;

a first pair of vertical braces extending upward from the forward end of said rocker frames;

a second pair of vertical braces extending upward from a rearward portion of said rocker frames;

a seatrest having its forward end pivotally supported upon said first pair of braces;

a footrest pivotally depending from said seatrest;

a backrest secured to the rearward end of said seatrest, and being pivotally supported from a mid-point along its length upon said second pair of braces;

the lower ends of both said pairs of braces being pivotal fore and aft relative to said rocker frames; and manually operated drive means for selectively adjusting the angular position of said second pair of braces relative to said rocker frames, thereby to determine the angle of recline of said chair.

13. In an adjustable chair, a body rest assembly comprising:

a seatrest;

a footrest depending from the forward end of said seatrest, and being pivotally supported thereby;

a backrest hingedly attached to the rearward end of said seatrest;

spring means coupled between said seatrest and said footrest for supporting said footrest;

first friction brake means coupled between said seatrest and said footrest for inhibiting their relative pivotal movement;

second friction brake means coupled between said seatrest and said backrest for inhibiting relative pivotal movement thereof;

means provided on the forward end of said seatrest for pivotally supporting the same; and means provided at a mid-point along the length of said backrest for pivotally supporting said backrest.

14. In an adjustable chair, the combination comprising:

a seatrest;

front and rear suspension means adjustably supporting said seatrest;

a footrest having its rearward end pivotally attached to the forward end of said seatrest;

a pair of cam pulleys carried by the rearward end of said footrest on respective sides thereof, each of said cam pulleys having one portion of its circumference in which its radius is reduced;

a pair of cables extending along respective sides of said seatrest, the forward ends of said cables being secured upon respective ones of said cam pulleys; and separate spring means carried by said seatrest for resiliently loading each of said cables;

the action being such that when said footrest is tilted downward to the maximum extent, said cables then engage the reduced-radius portions of said pulley wheels.

15. In an adjustable reclining rocking chair, the combination comprising:

a pair of rocker frames having rocker beams whose floor-engaging surfaces define essentially an arc of a circle;

a pair of load-bearing devices supported on respective ones of said frames;

a body rest assembly supported by said load-bearing devices on its respective sides; and means for selectively moving said load-bearing devices along arcuate paths which are substantially concentric to said circle arc, thereby making it possible to move the center of gravity of the body rest assembly and its occupant either forward or aft relative to the rocker frames but without substantially raising or lowering said center of gravity relative to the floor surface.

16. An adjustable reclining rocking chair comprising:

a body rest assembly including a footrest, a seatrest, and a backrest pivotally joined together in a series arrangement;

a rocker frame assembly including a pair of curved rocker beams;

front and rear suspension means adjustably supporting said body rest assembly upon said rocker frame assembly; and linkage means coupling said footrest to said rear suspension means and being responsive to a downward pivoting movement of said footrest for moving said body rest assembly forward relative to said rocker frame assembly upon said rear suspension means, and being also responsive to an upward pivoting movement of said footrest for moving said body rest assembly rearward relative to said rocker frame assembly upon said rear suspension, so that the center of gravity of said body rest assembly maintains a substantially constant position longitudinally of said rocker frame assembly and thereby maintains a substantially constant angle of recline of said rocker frame assembly.

17. In an adjustable chair, the combination comprising:

a seatrest;

a backrest hingedly coupled to the rearward end of said seatrest;

a forward suspension pivotally coupled to the forward end of said seatrest;

a rear suspension pivotally coupled to said backrest at a mid-point along its length; and means for adjusting the horizontal distance between said suspensions so as to permit adjusting the angular relationship between said seatrest and backrest, whereby the combination of said seatrest and backrest may be moved between sit-up and reclining positions thereof without substantially raising or lowering their composite center of gravity.

18. A reclining rocking chair with universal adjustment capabilities, comprising:

a rocker frame assembly including a pair of curved rocker beams;

a body rest assembly including a footrest, a seatrest, and a backrest pivotally coupled in series;

front suspension means including a pair of vertical braces having their lower ends pivotally coupled to the forward ends of respective rocker beams and their upper ends pivotally coupled to respective front corners of said seatrest;

a pair of support devices pivotally coupled to respective sides of said backrest at a mid-point along its length;

rear suspension means supporting said support devices from said rocker frame assembly;

recline adjustment means cooperatively associated with said rear suspension means and manually operable for moving said support devices along arcuate paths which are substantially concentric to the curved floor-engaging surfaces of said rocker beams; and linkage means coupled between said footrest and said support devices and operable to move said support devices in a horizontal forward or rearward direction in response to a downward or upward pivotal movement, respectively, of said footrest.

19. An adjustable reclining rocking chair comprising:

a rocker frame assembly;

a body rest assembly;

separate front and rear suspension means supporting said body rest assembly upon said rocker frame assembly; and adjustable means for moving a portion of said rear suspension means along an arcuate path which is substantially concentric to the arcuate floor-engaging rocker surfaces, so as to cause the chair and its occupant to incline either forwardly or rearwardly but without significantly changing the elevation above the floor surface of either the center of gravity of the body rest assembly or the center of gravity of the chair occupant.

20. An adjustable chair as in claim 19 wherein said adjustable means is manually operable and may be reached by the chair occupant without significantly disturbing his body rest position.

21. An adjustable rocking chair comprising:

a rocker frame assembly;

a body rest assembly including a seatrest, a backrest, and a footrest pivotally coupled to said seatrest;

means adjustably suspending said body rest assembly from said rocker frame assembly; and means responsive to a change in the angular position of said footrest relative to said seatrest for actuating said adjustment means so as to avoid any substantial shift of the combined center of gravity of said body rest assembly and its occupant in either a forward or a rearward direction relative to said rocker frame assembly.

22. An adjustable rocking chair comprising:

a rocker frame assembly;

a body rest assembly including a footrest, a seatrest, and a backrest pivotally coupled to said seatrest;

means adjustably suspending said body rest assembly from said rocker frame assembly; and means responsive to a change in the angular position of said backrest relative to said seatrest for actuating said adjustment means so as to avoid any substantial shift of the combined center of gravity of said body rest assembly and its occupant in either a forward or a rearward direction relative to said rocker frame assembly.

23. An adjustable rocking chair comprising:

a rocker frame assembly;

a body rest assembly including a footrest, a seatrest, and a backrest pivotally coupled in series;

means adjustably suspending said body rest assembly from said rocker frame assembly; and means responsive to any combination of changes in the relative angular positions of said footrest, seatrest, and backrest for actuating said adjustment means so as to avoid any substantial shift of the combined center of gravity of said body rest assembly and its occupant in either a horizontal or a vertical direction relative to said rocker frame assembly.

24. A chair as in claim 23 wherein the angular positions of said footrest and said backrest relative to said seatrest may be adjusted to any desired angle within a range of adjustability.

25. In the art of adjusting a rocking chair having a rocker frame with seatrest, footrest, and backrest adjustably supported therefrom, the method of compensating for a fully downward tilting movement of the footrest, which consists in moving the seatrest and backrest forward relative to the rocker frame by a distance of about 1¾ inches.

26. In the art of adjusting a rocking chair having a rocker frame with seatrest, footrest, and backrest adjustably supported therefrom, the method of compensating for adjustment of the backrest from a nearly vertical position to a substantially horizontal position, which consists in pivoting the backrest about a horizontal axis located at a mid-point along its length and concurrently moving the seatrest forward relative to the rocker frame by a distance of about nine inches.

27. The method of adjusting the angle of recline of a reclining rocking chair having a rocker frame and a body rest assembly adjustably supported from said rocker frame, but without substantially raising or lowering the center of gravity of the body rest assembly, which consists in adjustably moving portions of the body rest assembly along paths which are substantially parallel to the floor-engaging surfaces of the rocker frame.

28. An adjustable reclining chair comprising:

a rocker frame assembly including means providing front and rear suspensions, the position of said rear suspension being adjustable relative to said rocker frame assembly;

manually operated drive means for adjusting said rear suspension relative to said rocker frame assembly;

a body rest assembly including a seatrest, a backrest, and means hingedly securing the rearward end of said seatrest to the forward and lower end of said backrest;

means pivotally securing the forward end of said seatrest to said front suspension;

means pivotally securing said backrest, at a midpoint along the length thereof, to said rear suspension; and means for adjusting the horizontal distance between said front and rear suspensions, thereby permitting the angle of inclination of said backrest to be adjusted.

29. A chair as in claim 28 which further includes braking means for restraining pivotal movement of said backrest relative to said seatrest.

30. A chair as in claim 28 which further includes a footrest extending forwardly of said seatrest, means pivotally securing the rearward end of said footrest to the forward end of said seatrest, and braking means for restraining pivotal movement of said footrest.

31. A chair as in claim 30 which further includes a spring counterbalance coupled between said seatrest and said footrest and operable for at least partially supporting the weight of said footrest.

32. A chair as in claim 28 wherein said rocker frame assembly includes a parallel pair of longitudinally rounded, upwardly convex arms disposed above the sides of the space normally occupied by said seatrest.

33. A chair as in claim 28 wherein said front suspension includes a pair of substantially vertical arms having their lower ends pivotally attached to the forward ends of the rockers of said rocker frame, the upper ends of said arms being pivotally secured to said seatrest.

34. A chair as in claim 28 wherein said rear suspension includes a pair of substantially horizontal slide means, said pivotal securement means for said backrest being slidably mounted upon said slide means for movement either forwardly or rearwardly relative to said rocker frame assembly.

35. An adjustable reclining chair comprising:

a body rest assembly including a seatrest, a backrest, and means hingedly securing the rearward end of said seatrest to the forward and lower end of said backrest;

a rocker frame assembly including means providing front and rear suspensions, said front suspension including a pair of substantially vertical arms having their lower ends pivotally attached to the forward ends of the rockers of said rocker frame, the upper ends of said arms being pivotally secured to said seatrest;

means pivotally securing the forward end of said seatrest to said front suspension;

means pivotally securing said backrest, at a mid-point along the length thereof, to said rear suspension; and means for adjusting the horizontal distance between said front and rear suspensions, thereby permitting the angle of inclination of said backrest to be adjusted.

36. A chair as in claim 35 which further includes braking means for restraining pivotal movement of said backrest relative to said seatrest.

37. A chair as in claim 35 which further includes a footrest extending forwardly of said seatrest, means pivotally securing the rearward end of said footrest to the forward end of said seatrest, and braking means for restraining pivotal movement of said footrest.

38. A chair as in claim 37 which further includes a spring counterbalance coupled between said seatrest and said footrest and operable for at least partially supporting the weight of said footrest.

39. A chair as in claim 35 wherein said rocker frame assembly includes a parallel pair of longitudinally rounded, upwardly convex arms disposed above the sides of the space normally occupied by said seatrest.

40. A chair as in claim 35 wherein said rear suspension includes a pair of substantially horizontal slide means, said pivotal securement means for said backrest being slidably mounted upon said slide means for movement either forwardly or rearwardly relative to said rocker frame assembly.

41. An adjustable rocking chair comprising:

a body rest assembly including a footrest, a seatrest, and a backrest pivotally coupled in series;

a rocker frame assembly including a pair of fixed arms;

means adjustably suspending said body rest assembly from said rocker frame assembly; and means responsive to any combination of changes in the relative angular positions of said footrest, seatrest, and backrest for actuating said adjustment means so as to avoid any substantial shift of the combined center of gravity of said body rest assembly and its occupant in either a horizontal or a vertical direction relative to said rocker frame assembly;

said chair being adapted for adjustment of the position of said body rest assembly by the occupant of the chair, by gripping said arms and manipulating his body to a desired position.

42. A chair as in claim 41 wherein the angular positions of said footrest and said backrest relative to said seatrest may be adjusted to any desired angle within a range of adjustability.

43. A chair as in claim 41 which includes two separate braking means for restraining the pivotal movement of said backrest and of said footrest, respectively, relative to said seatrest.

* * * * *